US007607769B2

(12) United States Patent
Umeda et al.

(10) Patent No.: US 7,607,769 B2
(45) Date of Patent: Oct. 27, 2009

(54) REFILL UNIT

(75) Inventors: Takaichiro Umeda, Nagoya (JP); Yasutake Yamaguchi, Chiryu (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 541 days.

(21) Appl. No.: 11/605,864

(22) Filed: Nov. 29, 2006

(65) Prior Publication Data

US 2007/0132819 A1 Jun. 14, 2007

(30) Foreign Application Priority Data

Nov. 30, 2005 (JP) ..... 2005-346357

(51) Int. Cl.
*B41J 2/175* (2006.01)

(52) U.S. Cl. ..... 347/85

(58) Field of Classification Search ..... 347/37, 347/49, 85, 86

See application file for complete search history.

(56) References Cited

U.S. PATENT DOCUMENTS

| | | | | |
|---|---|---|---|---|
| 5,748,210 | A | 5/1998 | Watanabe et al. | |
| 5,933,173 | A * | 8/1999 | Solero | 347/85 |
| 6,059,396 | A * | 5/2000 | Choi | 347/37 |
| 6,170,940 | B1 | 1/2001 | Shinada et al. | |
| 6,250,750 | B1 | 6/2001 | Miyazawa et al. | |
| 6,655,793 | B2 * | 12/2003 | Jones et al. | 347/86 |
| 6,666,542 | B2 | 12/2003 | Yoshiyama et al. | |
| 6,736,486 | B2 * | 5/2004 | Nakamura et al. | 347/49 |
| 6,953,242 | B2 | 10/2005 | Yoshiyama et al. | |
| 7,018,027 | B2 | 3/2006 | Harada et al. | |
| 2004/0246284 | A1 | 12/2004 | Murai et al. | |
| 2005/0036015 | A1 | 2/2005 | Seino et al. | |
| 2005/0052511 | A1 | 3/2005 | Seino et al. | |
| 2005/0068382 | A1 | 3/2005 | Kimura et al. | |
| 2005/0116998 | A1 | 6/2005 | Harada et al. | |
| 2005/0152726 | A1 | 7/2005 | Ueda et al. | |
| 2005/0162494 | A1 | 7/2005 | Inokuchi et al. | |
| 2005/0168545 | A1 | 8/2005 | Sakai et al. | |
| 2005/0168547 | A1 | 8/2005 | Yoshiyama et al. | |
| 2005/0185036 | A1 | 8/2005 | Seino et al. | |
| 2005/0248637 | A1 | 11/2005 | Seino et al. | |

FOREIGN PATENT DOCUMENTS

| | | |
|---|---|---|
| JP | 6106730 | 4/1994 |
| JP | 8-197750 | 8/1996 |
| JP | 9123479 | 5/1997 |
| JP | 10-109427 | 4/1998 |
| JP | 11348303 | 12/1999 |
| JP | 2000015842 | 1/2000 |

(Continued)

*Primary Examiner*—Anh T. N. Vo

(57) ABSTRACT

A refill unit that includes a case, a door, a locking member and an unlocking member. The locking member slides between a protruded position and a retracted position and is engageable with the case at an intermediate position between the protruded position and the retracted position to lock the door in a closed position. the locking member is displaced toward the retracted position to release the engagement. The unlocking member is turnably supported on the door and is capable of moving, when the door is in the closed position, between a neutral position and a housed position. The unlocking member is displaced from the neutral position to a fallen position to displace the locking member from the intermediate position to the retracted position.

7 Claims, 17 Drawing Sheets

FOREIGN PATENT DOCUMENTS

| | | |
|---|---|---|
| JP | 2003-53947 | 2/2003 |
| JP | 2003-53999 | 2/2003 |
| JP | 2004-345246 | 12/2004 |
| JP | 2005-96446 | 4/2005 |
| JP | 2005-219416 | 8/2005 |
| JP | 2005-254794 | 9/2005 |

* cited by examiner

REFILL UNIT

CROSS-REFERENCE TO RELATED APPLICATION

This application claims priority from Japanese Patent Application No. 2005-346357, filed on Nov. 30, 2005, the entire subject matter of which is incorporated herein by reference.

TECHNICAL FIELD

Aspects of the present invention relate to the structure of a refill unit to be mounted on an ink-jet recording device.

BACKGROUND

An ink-jet recording device records an image on a recording sheet being conveyed by ejecting ink droplets to the recording sheet. The ink is generally reserved in advance in a cartridge type ink tank (or an ink cartridge) and is fed from the ink cartridge to the recording head. As the residual of the ink reserved decreases, therefore, the ink cartridge has to be replaced by new one (see JP-A-11-348303, JP-A-10-109427, JP-A-2004-345246, JP-A-2005-219416 and JP-A-2005-96446, for example). Generally, the ink cartridge is housed and held in a case, and this case is arranged in the ink-jet recording device.

Ink-jet recording devices can be categorized into the so-called "on-carriage type" and "off-carriage type" according to the position of arrangement of the ink cartridge. In the on-carriage type, the ink cartridge is mounted on the carriage, which can be reciprocated to cross the direction to convey the recording sheet and which carries the recording head. Specifically, the aforementioned necessary case is mounted on the carriage, and the ink is fed from the ink cartridge housed and held in that case to the recording head. In the off-carriage type, on the other hand, the case is disposed somewhere in the ink-jet recording device excepting the carriage, and the ink cartridge is housed and held in that case. In other words, the ink cartridge and the case are constituted in advance into a unit, and this unit is assembled somewhere in the ink-jet recording device. As a result, the ink is fed from the case housing and holding the ink cartridge to the recording head through an ink supply pipe. This unit is called a "refill unit".

The case of the refill unit is generally provided with a door. This door is so closed that the ink cartridge is housed in the case. As a result, the ink cartridge is reliably housed and held in the case. In the case, an ink supply needle is arranged at a deep portion and is inserted, when the ink cartridge is housed in that case, into the ink cartridge. As a result, the ink in the ink cartridge is supplied through the ink supply needle and the ink supply pipe to the side of the recording head. At the time of replacing the ink cartridge, the door is opened, and the ink cartridge is extracted from the case (see JP-A-6-106730).

SUMMARY

The operation to replace ink cartridges has to be easy for a user of the ink-jet recording device. In case the refill unit for housing and holding the ink cartridge is arranged on the front face side of the ink-jet recording device, the ink-jet recording device is usually disposed such that its front face confronts the user. As a result, the ink cartridge is exposed, when replaced, to the user side. Therefore, the ink cartridge replacing operations are convenient for the user. In order to perform the ink cartridge replacing operations promptly, the door of the refill unit has to be provided with an openable structure. For performing the door opening/closing operations easily and quickly, it is desired that the door is provided with a knob or lever, and that the knob or lever is set to have large external sizes.

In case the refill unit is arranged in a casing of the ink-jet recording device, the casing of the ink-jet recording device has to be provided with an opening/closing door so that the refill unit may be exposed at the ink cartridge replacing time. Moreover, for operating the door of the refill unit easily when the opening/closing door is opened, the refill unit has to be arranged near the opening/closing door.

In case, however, the knob or lever attached to the door of the refill unit has large exterior sizes, as described hereinbefore, the knob or lever protrudes from the case of the refill unit so that the exterior sizes of the refill unit are enlarged. This makes it necessary to retain a space for housing the knob and the like between a casing wall face of the ink-jet recording device and the opening/closing door. As a result, the casing of the ink-jet recording device housing the refill unit is enlarged to the contrary of the request of recent years for designing the ink-jet recording device in a light weight and in a small size.

Aspects of the invention provide a compact refill unit, which can perform the ink cartridge replacing operations easily and quickly and which can contribute to reducing the size of an ink-jet recording device.

BRIEF DESCRIPTION OF THE DRAWINGS

FIG. 7 is a side elevation of an essential portion of a unit body of the refill unit;

DETAILED DESCRIPTION

Illustrative aspects of the invention will be described in detail with reference to the accompanying drawings.

Figure 1:
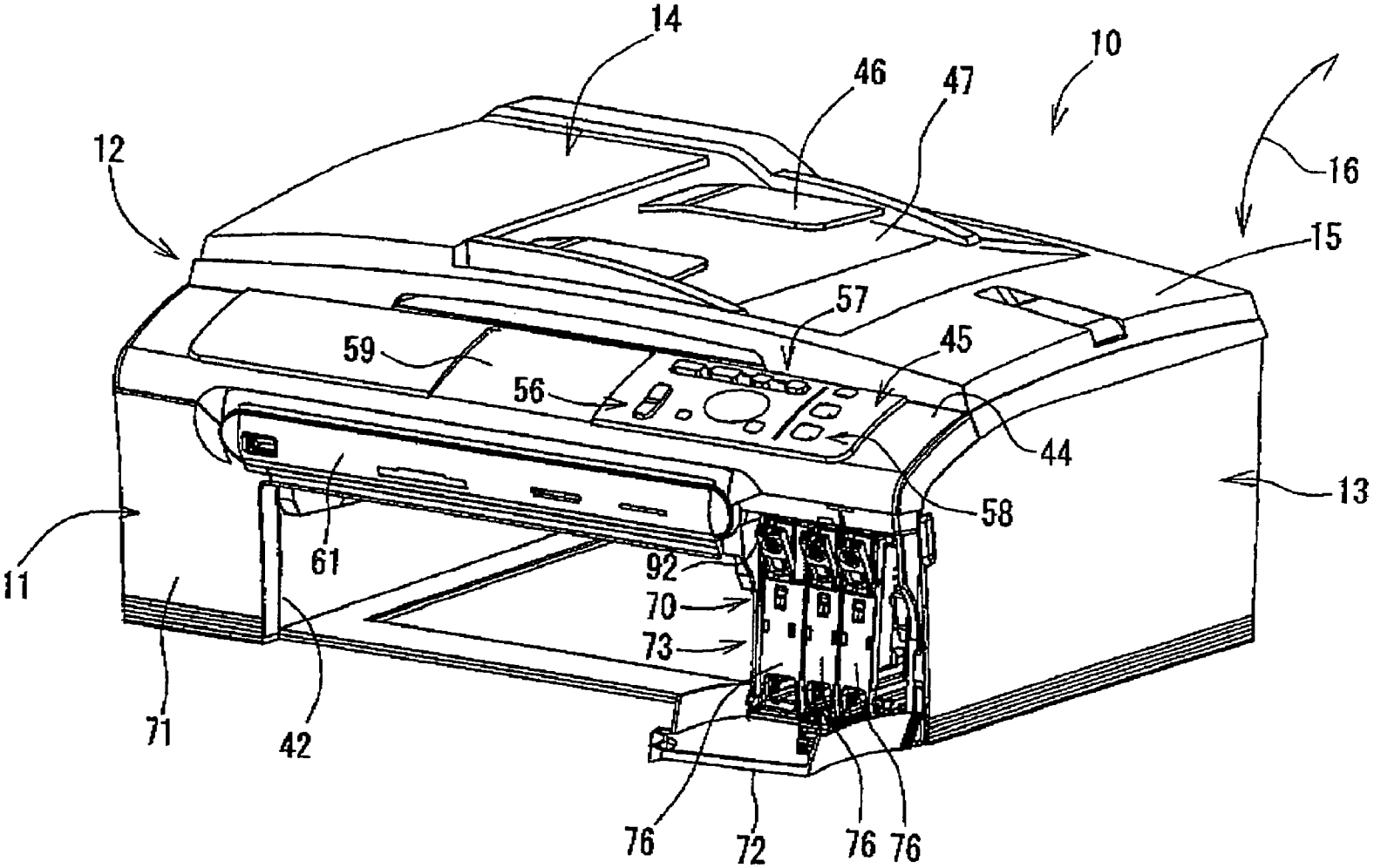
FIG. 1 is a perspective exterior view of a multifunction device.

FIG. 1 is a perspective exterior view of a multifunction device 10.

The multifunction device (MFD) 10 includes a printer unit 11 at its lower portion and a scanner unit 12 at its upper portion. The multifunction device 10 has a variety of functions such as a printer function, a scanner function, a copy function and a facsimile function. The multifunction device 10 may be connected with a computer (not shown) so that it records images or documents on recording sheets. Also, the multifunction device 10 may be connected with an external device such as a digital camera so that it can record the image data outputted from the digital camera on the recording sheet. The multifunction device 10 is provided with a slot unit 61, which will be described later, so that it can also record, when loaded with various recording media such as a memory card, the image data or the like stored in the memory media on the recording sheet.

In this multifunction device 10, the printer unit 11 is configured as an ink-jet recording device and provided on its front face with a refill unit 70 for reserving ink in advance, which is supplied to a recording head to eject ink droplets. The refill unit 70 is designed compact and is designed such that a user can easily extract an ink cartridge at the time of replacing the ink cartridge. The refill unit 70 assembled in the multifunction device 10 is an aspect of the invention. The design of the multifunction device 10 can be properly changed without departing from the scope of the invention.

Figure 2:
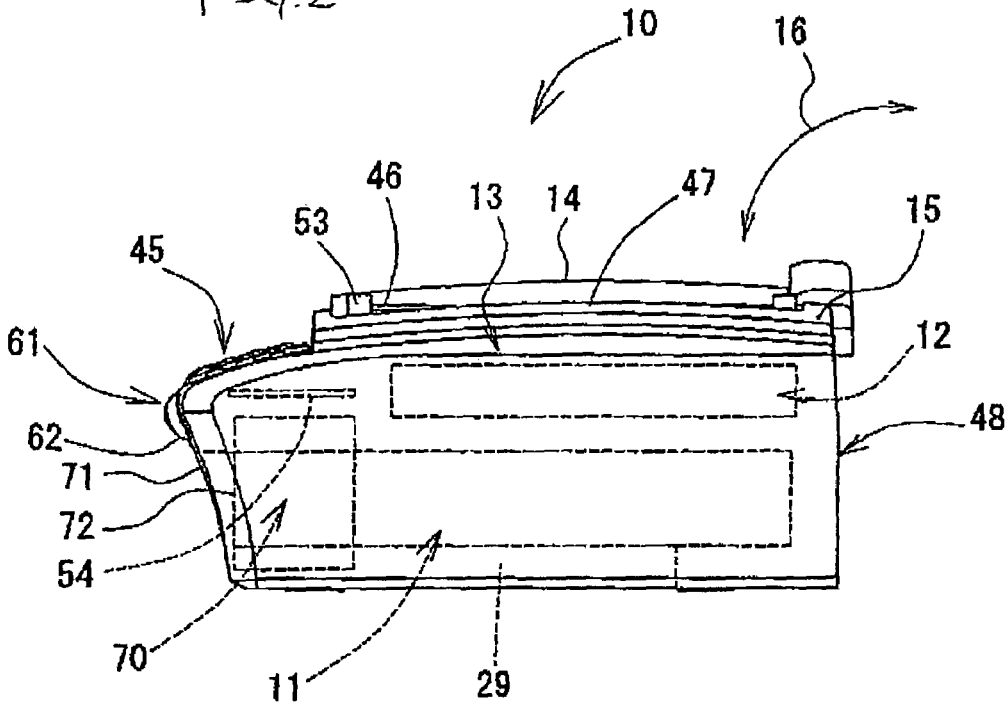
FIG. 2 is a diagram showing the internal structure of the multifunction device.
Figure 3:
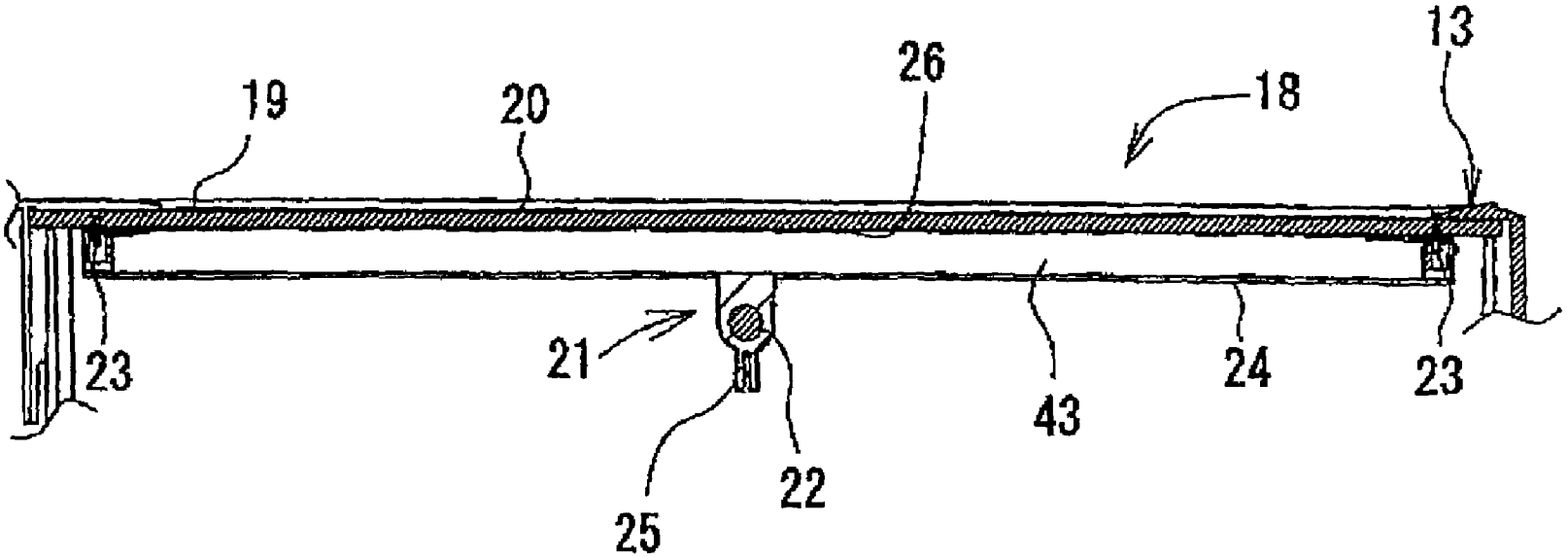
FIG. 3 is a diagram schematically showing the internal constitution of a scanner unit of the multifunction device.

FIG. 2 is a diagram schematically showing the internal structure of the multifunction device 10. FIG. 3 is a diagram schematically showing the internal structure of the scanner unit 12 (i.e., portions indicated by dotted lines in FIG. 2).

As shown in FIG. 2, the scanner unit 12 includes a document placing portion 13 functioning as a flat-bed scanner (FBS) and a document cover 15 disposed on the document placing portion 13. The document cover 15 is provided with an automatic document feeder (ADF) 14 and is openably attached through a hinge to a rear side of the document placing portion 13. As a result, the document cover 15 can be opened and closed by turning it in the directions of arrows 16 relative to the document placing portion 13. In this aspect, the placing portion 13 is formed by a casing of the multifunction device 10, and the document cover 15 forms a portion of the upper face of the multifunction device 10.

The document placing portion 13 also functions as a frame of the scanner unit 12. As shown in FIG. 3, a contact glass plate 20 is disposed at the top 19 of the document placing portion 13. An image reading unit 18 is arranged in the document placing portion 13. The document is placed between the document cover 15 and the contact glass plate 20. The image reading unit 18 reads an image from that document by moving below and along the contact glass plate 20 in the directions normal to the drawing sheet of FIG. 3.

The image reading unit 18 is provided with a CIS unit 21, a guide shaft 22, roller units 23 and a belt drive mechanism (not shown). In this aspect, the image reading unit 18 is provided with a CIS (Contact Image Sensor). Alternatively, an image sensor of a reducing optical system such as a CCD (Charged Coupled Device) can be adopted in place of the CIS. The CIS unit 21 is provided with an elongated box casing 43, which is fitted and supported by a carriage 24. The guide shaft 22 is disposed normal to the drawing sheet of FIG. 3. The guide shaft 22 extends through the lower end portion 25 of the carriage 24. The CIS unit 21 is supported by the guide shaft 22 such that it slides while being guided by the guide shaft 22. The belt timing mechanism is provided with a timing belt (not shown) driven by a motor, for example. This timing belt is connected at its portion to the lower end portion 25 of the carriage 24. When the belt drive mechanism operates, the carriage 24 moves together with the timing belt so that the CIS unit moves below the contact glass plate 20.

The roller units 23 are disposed at two end portions of the CIS unit 21. The roller units 23 abut against the back 26 of the contact glass plate 20. The roller units 23 roll the back 26 of the contact glass plate 20 along the moving directions of the carriage 24 as the carriage 24 moves. In other words, the roller units 24 support the smooth movement of the CIS unit 21. The roller units 23 also play the role of a spacer for keeping constant the spacing between the CIS unit 21 and the document placed on the contact glass plate 20.

As shown in FIG. 1, the document cover 15 is provided with the ADF 14. This ADF 14 feeds a predetermined number of documents successively from a document tray 47 to a discharge tray 46. The mechanism for delivering the document successively is built in the document cover 15. The ADF 14 is well-known and thus its detailed description is omitted here. Further, this ADF may also be eliminated from this aspect of the invention.

Figure 4:
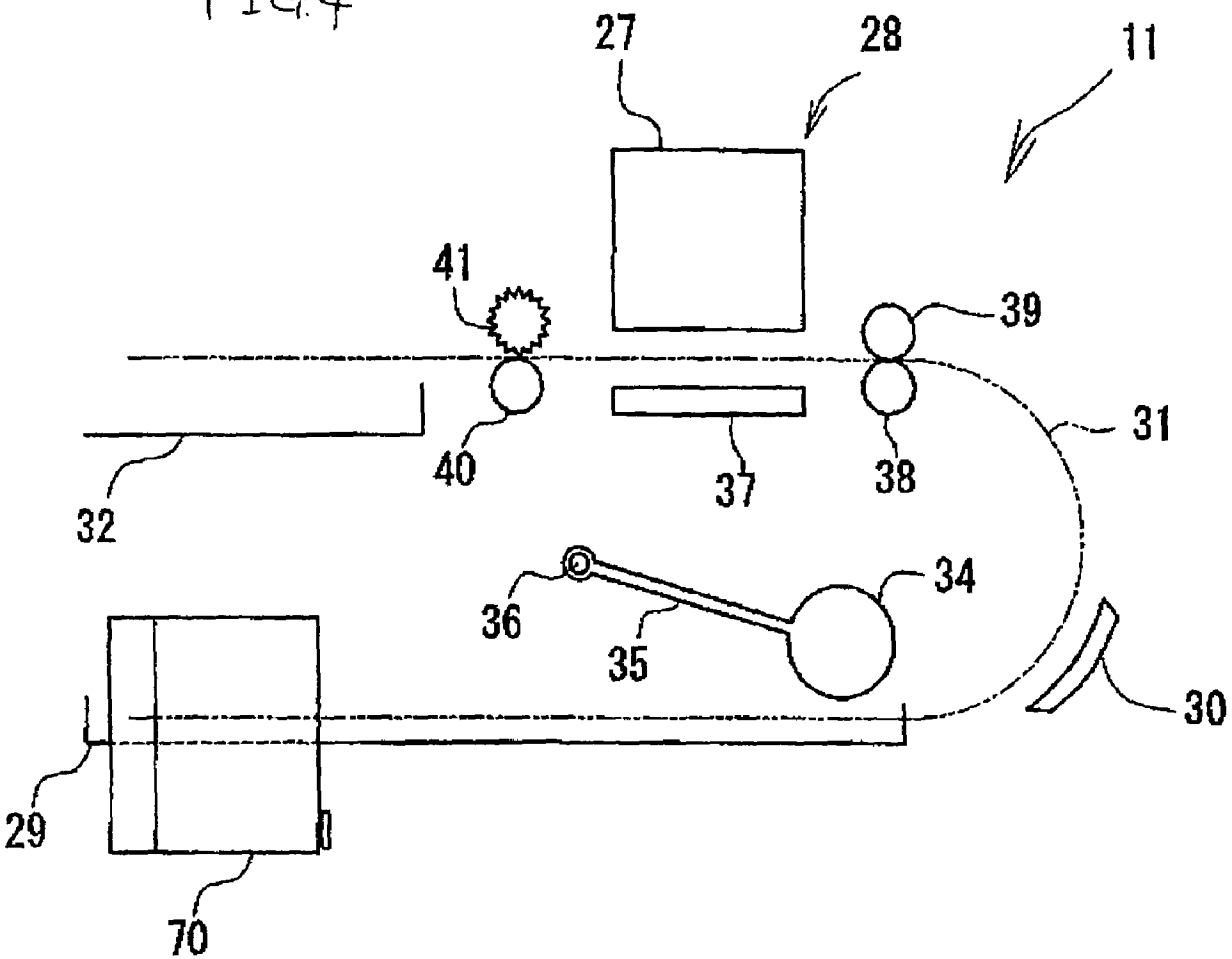
FIG. 4 is a diagram schematically showing the internal structure of a printer unit of the multifunction device.

FIG. 4 is a diagram showing the internal structure of the printer unit 11 (i.e., the portion indicated by dotted lines in FIG. 2) schematically. In FIG. 4, the direction normal to the drawing sheet is the widthwise direction of the multifunction device 10 and is aligned with the direction normal to the drawing sheet of FIG. 2.

As shown in FIG. 2 and FIG. 4, the printer unit 11 is provided with a frame formed by the document placing portion 13 and an image recording unit 28 having an ink-jet recording head 27. The printer unit 11 is configured as an ink-jet recording device in this aspect.

As shown in FIG. 4, the printer unit 11 is provided with the aforementioned refill unit 70. This refill unit 70 is built on the front side of the document placing portion 13 as shown in FIG. 1, that is, on the side of a front face 71. In this aspect, the refill unit 70 can house and hold four ink cartridges. The individual ink cartridges reserve inks of individual colors of black, yellow, magenta and cyan. These individual color inks reserved in those ink cartridges are supplied to the recording head 27 through ink tubes (or supply pipes). The ink tubes are not shown in FIG. 4.

As shown in FIG. 1, the document placing portion 13 forming the frame of the printer unit 11 has an opening/closing cover 72 on the side of the aforementioned front face 71. The opening/closing cover 72 opens and closes an opening 73 formed at an end portion of the front face 71. The opening/closing cover 72 can be turned between the position, in which it exposes, when felled forward, the refill unit 70 from the opening 73, and the position, in which it closes the opening 73 to house the refill unit 70.

The document placing portion 13 is provided at its front center with an opening 42, in which a sheet tray 29 is arranged as shown FIG. 4. The recording sheet fed out from the sheet tray 29 is recorded with the image and is discharged to a discharge tray 32 disposed in the opening 42. On the rear side (or on the right side in FIG. 4) of the sheet tray 29, there is arranged a separating slope plate 30. This separating slope plate 30 separates the recording sheet stacked on the sheet tray 29 and guides it upward. Upward from the separating slope plate 30, there is formed a sheet convey passage 31. This sheet convey passage 31 extends upward, curves leftward, and extends from the rear side to the front side of the multifunction device 10. The sheet convey passage 31 extends through the image recording unit 28 to the discharge tray 32. The recording sheet housed in the sheet tray 29 is guided by the sheet convey passage as to make a U-turn from below to above, so that it arrives at the image recording unit 28. The recording sheet being conveyed to the sheet convey passage 31 is recorded with the image by the image recording unit 28 and is then discharged to the discharge tray 32. The discharge tray 32 and the sheet tray 29 are not shown in FIG. 1.

On the upper side of the sheet tray 29, as shown in FIG. 4, there is disposed a sheet feed roller 34. This sheet feed roller 34 separates the recording sheets stacked on the sheet tray 29 one by one, and feeds them to the sheet convey passage 31. The structure of the sheet feed roller 34 is well known. The sheet feed roller 34 is supported at a leading end of a sheet feed arm 35. This sheet feed arm 35 can be vertically moved into and out of contact with the sheet tray 29. The sheet feed roller 34 is connected to a motor through a drive transmission mechanism (not shown). This drive transmission mechanism can be configured by a plurality of meshing gears. When the motor operates, its driving force is transmitted to rotate the sheet feed roller 34. The sheet feed roller 34 thus rotated feeds the recording sheet to the sheet convey passage 31.

The sheet feed arm 35 is rotatably supported at its base end by a shaft 36. Thus, the sheet feed arm 35 can swing vertically about the shaft 36. The sheet feed arm 35 is urged, when the sheet tray 29 is mounted, toward the sheet tray 29 by a sheet feed clutch or spring (not shown). The sheet feed arm 35 retracts to the upper side when the sheet tray 29 is inserted or drawn. When the sheet feed arm 35 is turned to the lower side, the sheet feed roller 34 borne at the leading end of that arm is pressed to contact with the surface of the recording sheet on the sheet tray 29. When the sheet feed roller 34 rotates in this state, the frictional force between the roller face of the sheet feed roller 34 and the recording sheet sends out the uppermost recording sheet to the separating slope plate 30. This recording sheet thus sent out is guided upward, while its leading end abutting against the separating slope plate 30, so that it is fed into the sheet convey passage 31. When the uppermost recording sheet is sent out by the sheet feed roller 34, the recording sheet just below may be sent out together by the action of friction or static electricity. However, this recording sheet is separated by abutting against the separating slope plate 30.

The sheet convey passage 31 is defined, excepting the portion where the image recording unit is arranged, by an outer side guide face and an inner side guide face confronting each other at a predetermined spacing. In this multifunction device 10, the outer side guide face is formed by an inner wall face of the frame of the printer unit 11 formed of the document placing portion 13. The inner side guide face is formed by a surface of a guide member disposed in that frame. Further, convey rollers may be disposed especially at the curved portion of the sheet convey passage 31. Although the convey rollers are not shown in FIG. 4, they may be disposed so as to rotate on center axes, which are taken in the widthwise direction of the sheet convey passage 31 (that is, in the direction normal to the drawing sheet of FIG. 4). The convey rollers are so attached that their roller faces are exposed to the outer side guide face or inner side guide face. By providing those convey rollers, the recording sheet is smoothly conveyed in contact with the guide face even at the portion where the sheet convey passage 31 is curved.

The image recording unit 28 is disposed on the downstream side after the sheet convey passage 31 turned from downward to upward. A platen 37 is disposed to confront the recording head 27. The recording sheet being conveyed is sent on the platen 37. The recording head 27 ejects the ink droplets to the recording sheet arranged on the platen 37. The recording head 27 is carried on a carriage (not shown). This carriage is reciprocated in the directions normal to the paper sheet of FIG. 4 by a CR motor. The position and the reciprocation of the recording head 27 are monitored by a carriage encoder (not shown). The recording head 27 ejects, while being reciprocated, the individual color inks as the ink droplets to the recording sheet so that the image is recorded on the recording sheet.

The sheet convey passage 31 is provided, on the upstream side of the recording head 27, with a drive roller 39 and a presser roller 38. The drive roller 39 is rotationally driven by an LF motor (not shown). These drive roller 39 and presser roller 38 clamp the recording sheet being conveyed in the sheet convey passage 31. As the drive roller 39 is rotated, the recording sheet is delivered to the downstream side of the sheet convey passage 31 so that it is arranged on the platen 37.

The sheet convey passage 31 is provided, on the downstream side of the recording head 27, with a discharge roller 40 and a presser roller 41. The discharge roller 40 is rotationally driven by the LF motor for driving the drive roller 39. In other words, the discharge roller 40 is driven synchronously with the drive roller 39 through an interlocking mechanism (not shown). These discharge roller 40 and presser roller 41 clamp the recording sheet, to which the ink droplets have been ejected. As the discharge roller 40 is rotated, the recording sheet is conveyed to the downstream side of the sheet convey passage 31.

The presser roller 38 is elastically urged to the drive roller 39 so as to press the drive roller 39 with a predetermined pressure. When the recording sheet proceeds into a clearance between the drive roller 39 and the presser roller 38, the presser roller 38 is elastically retracted to an extent corresponding to the thickness of the recording sheet. In cooperation with the drive roller 39, the presser roller 38 clamps the recording sheet. The recording sheet is nipped by the drive roller 39 and the presser roller 38 so that the rotating force of the drive roller 39 is firmly transmitted to the recording sheet. The presser roller 41 is likewise disposed with respect to the discharge roller 40. In this aspect, the roller face is formed into such a spurred shape as to prevent the image recorded on the recording sheet from being degraded, because the presser roller 41 is urged to the recording sheet recorded.

The recording sheet clamped between the drive roller 39 and the presser roller 38 is intermittently conveyed with a predetermined line feed width over the platen 37. The recording head 27 is forwarded and returned at every line of the recording sheet so that it records the images sequentially from the leading end side of the recording sheet. The recording sheet is so intermittently conveyed with a predetermined line feed width while its leading end side being clamped between the discharge roller 40 and the presser roller 41 and its trailing end side being clamped between the drive roller 39 and the presser roller 38, so that it is recorded, while being conveyed, with the image by the recording head 27. After the image is recorded in the predetermined area of the recording sheet, the discharge roller 40 is continuously rotationally driven so that the recording sheet clamped by the discharge roller 40 and the presser roller 41 is discharged to the discharge tray 32.

As shown in FIG. 1, on an upper slope face of the frame of the printer unit 11 formed by the document placing portion 13, there is provided an operation panel 45. This operation panel 45 is a device for operating the printer unit 11 and the scanner unit 12 and is provided on its upper face 44 with various operation keys 56 to 58, a liquid crystal display 59 and so on. The document placing portion 13 is provided at its lower portion with a control device (not shown) for controlling the operations of the printer unit 11 and the scanner unit 12 and the entire operations of the multifunction device 10.

As shown in FIG. 2, a control board 54 is arranged below the operation panel 45 (or inside of the document placing portion 13). The various operation keys 56 to 58 arranged over the operation panel 45 are connected with the control board 54 through flat cables (not shown). The control board 54 is connected with the aforementioned control device, and this control device controls the operations of the multifunction device 10 by processing commands coming from the various operation keys 56 to 58.

The user of the multifunction device 10 inputs a desired command by using the various operation keys 56 to 58 of the operation panel 45. In response to this input, the multifunction device 10 performs a predetermined operation. As described, the personal computer or the like can be connected with that multifunction device 10. The multifunction device 10 can operate in response to not only the instruction from the operation panel 45 but also the instruction, which is transmitted from the personal computer through a scanner driver, a printer drive or the like.

As shown in FIG. 1, the slot unit 61 is arranged on the front of the multifunction device 10. This slot unit 61 can be loaded with a storage medium such as a variety of small-sized memory cards. The small-sized memory card can store image data, which is read out of the small-sized memory card loaded in the slot unit 61 so that the information on that image data is displayed in the liquid crystal display 59. An arbitrary image thus displayed in the liquid crystal display 59 is recorded on the recording sheet by the printer unit 11. The inputting operation for recording is performed through the operation panel 45.

Figure 5:
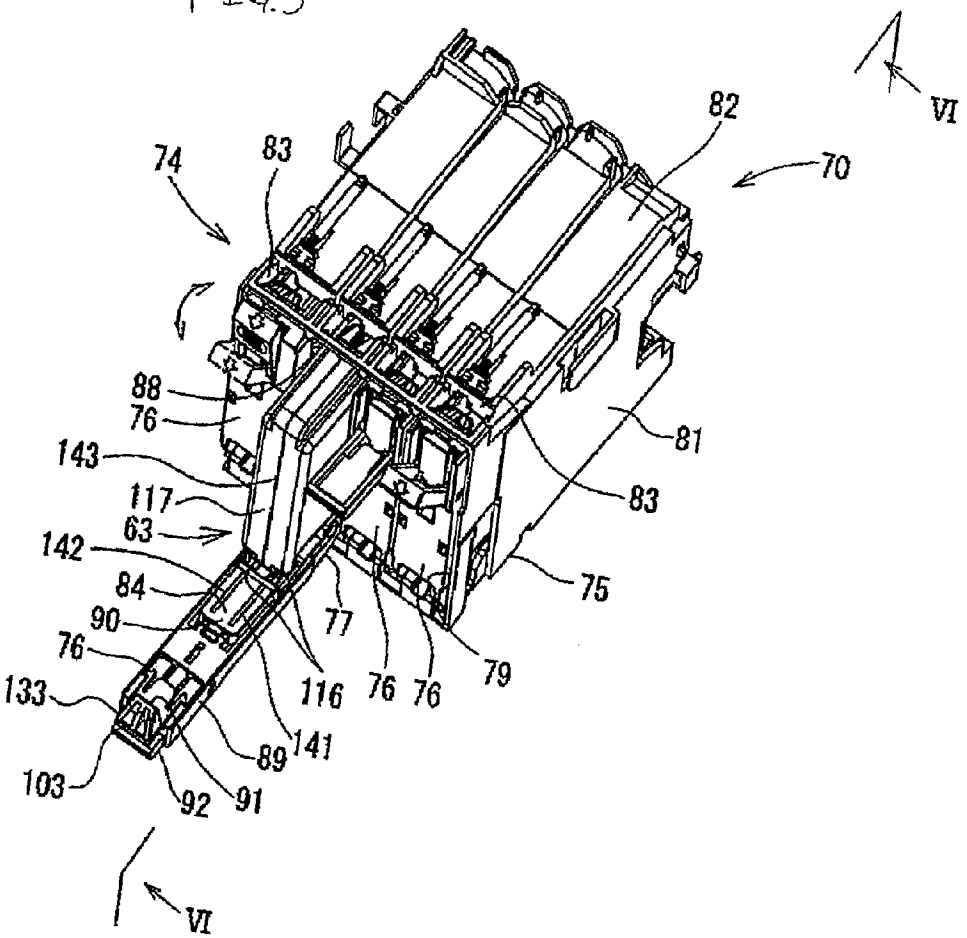
FIG. 5 is a perspective view of a refill unit according to one aspect of the invention.
Figure 6:
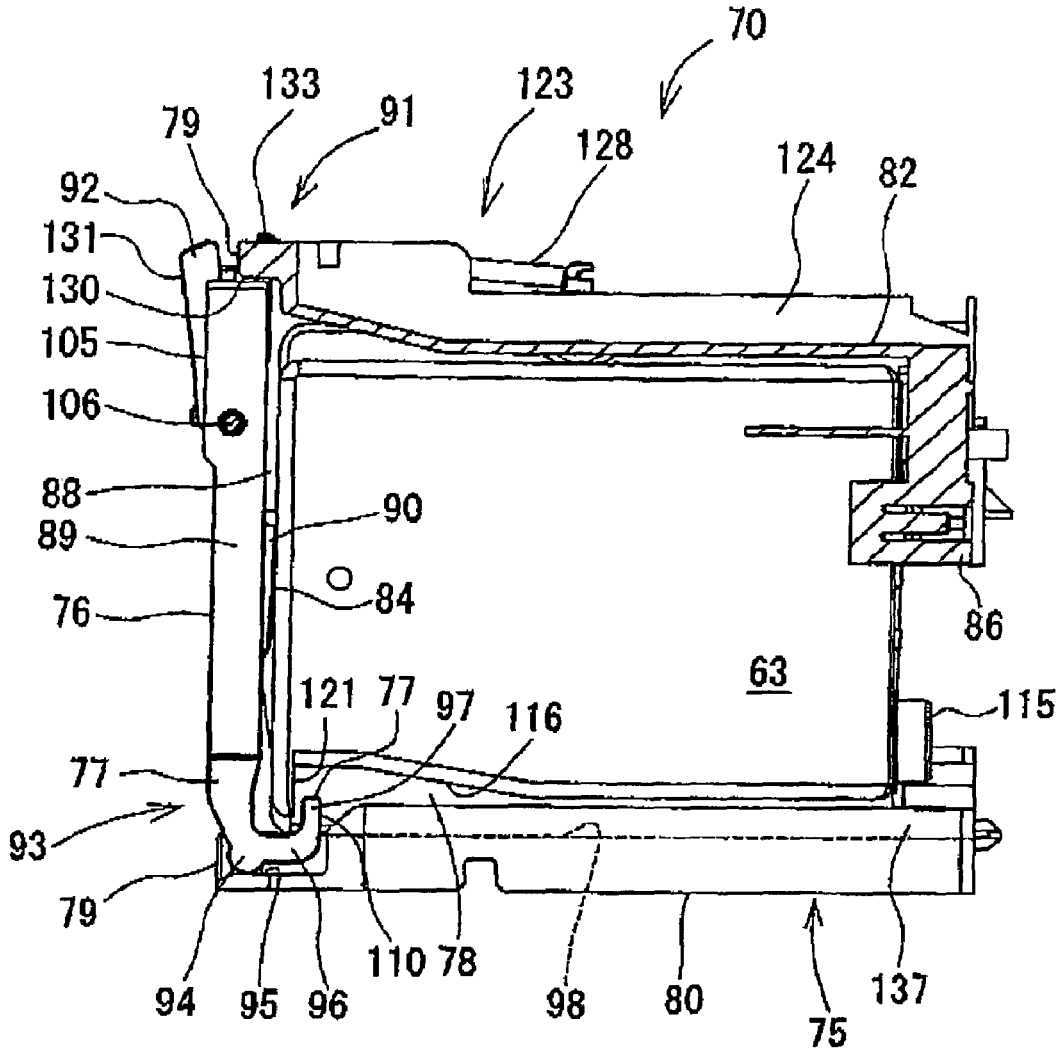
FIG. 6 is a sectional view taken along line VI-VI of FIG. 5.
Figure 17:
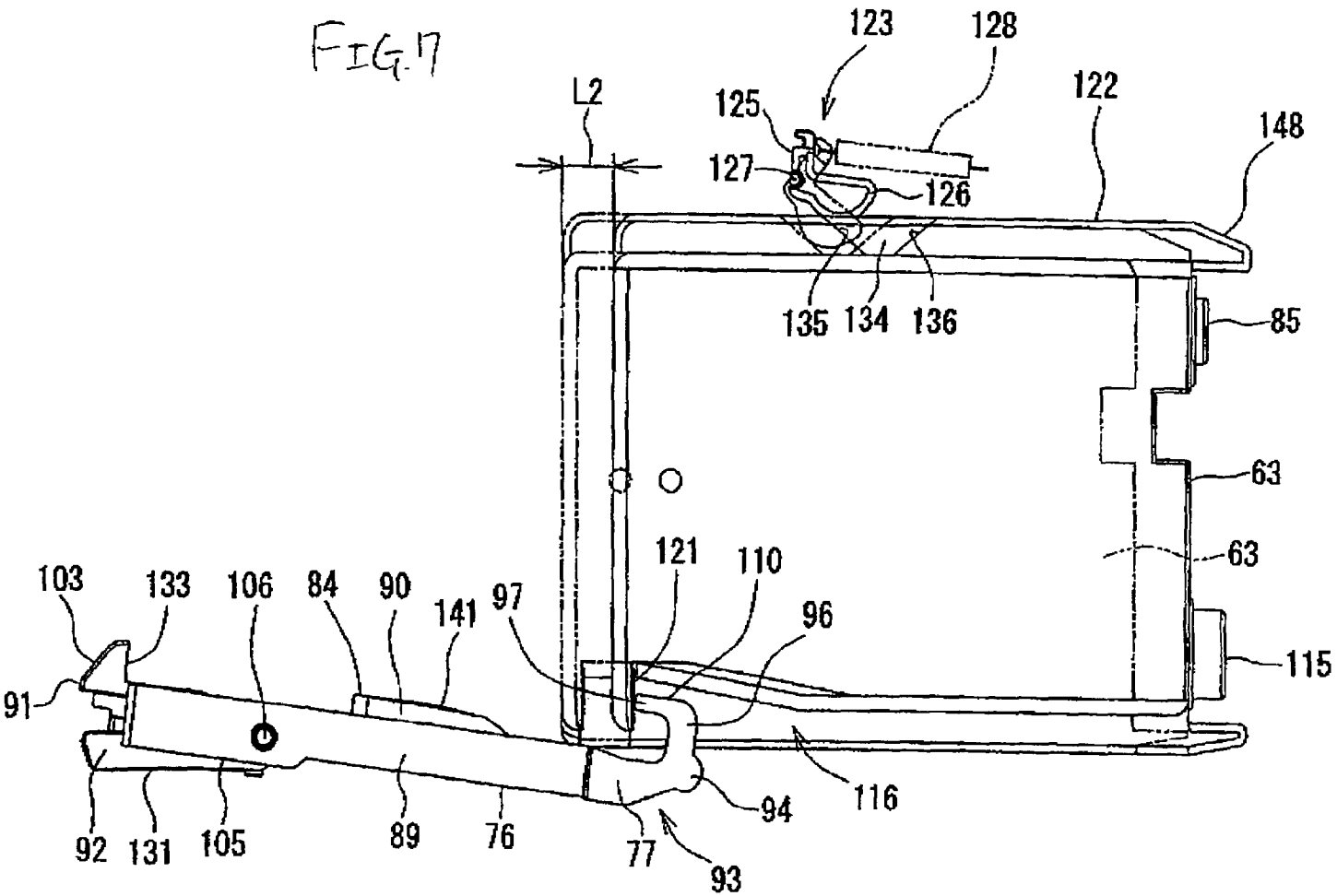
FIGS. 17A and 17B are diagrams schematically showing another modification of the fitting structure of the ink cartridge, case and drawer member.

FIG. 5 is a perspective view of the refill unit 70. FIG. 6 is a sectional view taken along line VI-VI of FIG. 5.

This refill unit 70 is provided with a unit body 74. The unit body 74 is capable of housing and holding the ink cartridges 63.

The unit body 74 is provided with a case 75, into and out of which the ink cartridge 63 is inserted and extracted, a door 76 attached to the case 75, and a drawer member 77 attached to the door 76.

The case 75 is formed of resin, for example, generally into a box shape as a whole. In the case 75, there are defined and formed (see FIG. 6) housing chambers 78 (or holding portions) for housing and holding the ink cartridge 63. In this aspect, the case 75 has the four housing chambers 78, into and out of which the four ink cartridges 63 are inserted and extracted. Each housing chamber 78 has an inner wall shape corresponding to the outer peripheral shape of the ink cartridge 63. As a result, each ink cartridge 63 can be held reliably without any looseness in the case 75.

The case 75 is provided with a bottom plate portion 80, a pair of side plate portions 81 erected from the two right and left sides of the bottom plate portion 80, a top plate portion 82 arranged to bridge the side plate portions 81, and partition portions (not shown) for partitioning the individual housing chambers 78. These partition portions are arranged according to the number of the ink cartridges 63 to be housed in the case 75. The partition portions need not be provided to define the individual housing chambers 78 completely but may be formed in such a rib shape on the bottom plate portion 80 as to partition the adjoining housing chambers 78. It is preferred that those bottom plate portion 80, the side plate portions 81, the top plate portion 82 and the partition portions are integrally formed.

On a rear side of the case 75, there is protruded a push rod (not shown). This push rod is protruded to the side of the housing chamber 78 and is inserted, when the ink cartridge 63 is housed in the case 75, into an air introduction valve 85 (see FIG. 7, FIG. 13 and FIG. 14), which is disposed in the ink cartridge 63. As a result, the air can proceed into the ink cartridge 63 through the air introduction valve 85 so that the ink in the ink cartridge 63 can be smoothly supplied to the recording head 27. As shown in FIG. 6, the case 75 is provided on its rear side with a liquid level sensor connector 86. This liquid level sensor connector 86 is connected, when the ink cartridge 63 is housed in the case 75, with a liquid level sensor 87 (see FIG. 14) disposed in the ink cartridge 63. This liquid level sensor connector 86 is connected with the aforementioned control device, which always monitors the remainder of the ink reserved in each ink cartridge 63.

As shown in FIG. 6, the upper face of the aforementioned bottom plate portion 80 forms a placing face 98 for placing the ink cartridge 63. The height position of the placing face 98 is set such that the ink supply pipe (not shown) is inserted, when the ink cartridge 63 is inserted into the housing chamber 78, into an ink supply valve 115 (see FIG. 14) of the ink cartridge 63, such that the aforementioned push rod can be inserted into the air introduction valve 85 (see FIG. 14) of the ink cartridge 63, and such that the aforementioned liquid level sensor connector 86 can be fitted in the liquid level sensor 87 (see FIG. 14) of the ink cartridge 63.

From the top plate portion 82, as shown in FIG. 6, there is erected a rib 124, by which the rigidity of the case 75 is improved. The top plate portion 82 is provided with a swing arm 123. FIG. 7 is a side elevation of the unit body 74 and schematically shows the relation between the opening/closing of the door 76 and the swing arm 123.

This swing arm 123 is generally formed into the shape of letter L, as shown in FIG. 7, to have a first arm 125 and a second arm 126. At the boundary portion between the first arm 125 and the second arm 126, there is arranged a support pin 127, at which the swing arm 123 is turnably supported. A tension spring 128 is mounted between the first arm 125 and the top plate portion 82. As a result, the swing arm 123 is so elastically urged as to be turned clockwise at all times, i.e., as to take the position, as indicated by double-dotted lines in FIG. 7. The swing arm 123 is thus elastically urged so that it is enabled to change into the position, as indicated by solid lines, by receiving the counter-clockwise turning force against that elastic force. This swing arm 123 can engage with the upper face 122 of the ink cartridge 63, as will be described later, so that it can expel the ink cartridge 63 forcibly from the aforementioned housing chamber 78.

As shown in FIG. 5 and FIG. 6, the case 75 is provided on its front face 79 with an opening 88. This opening 88 is formed for each housing chamber 78. In other words, the individual housing chambers 78 are communicated with the individual openings 88 and in the case 75, and the four ink cartridges 63 are individually inserted and extracted through the openings 88 from the sides of the front faces 79 into and out of the individual housing chambers 78.

Figure 8:
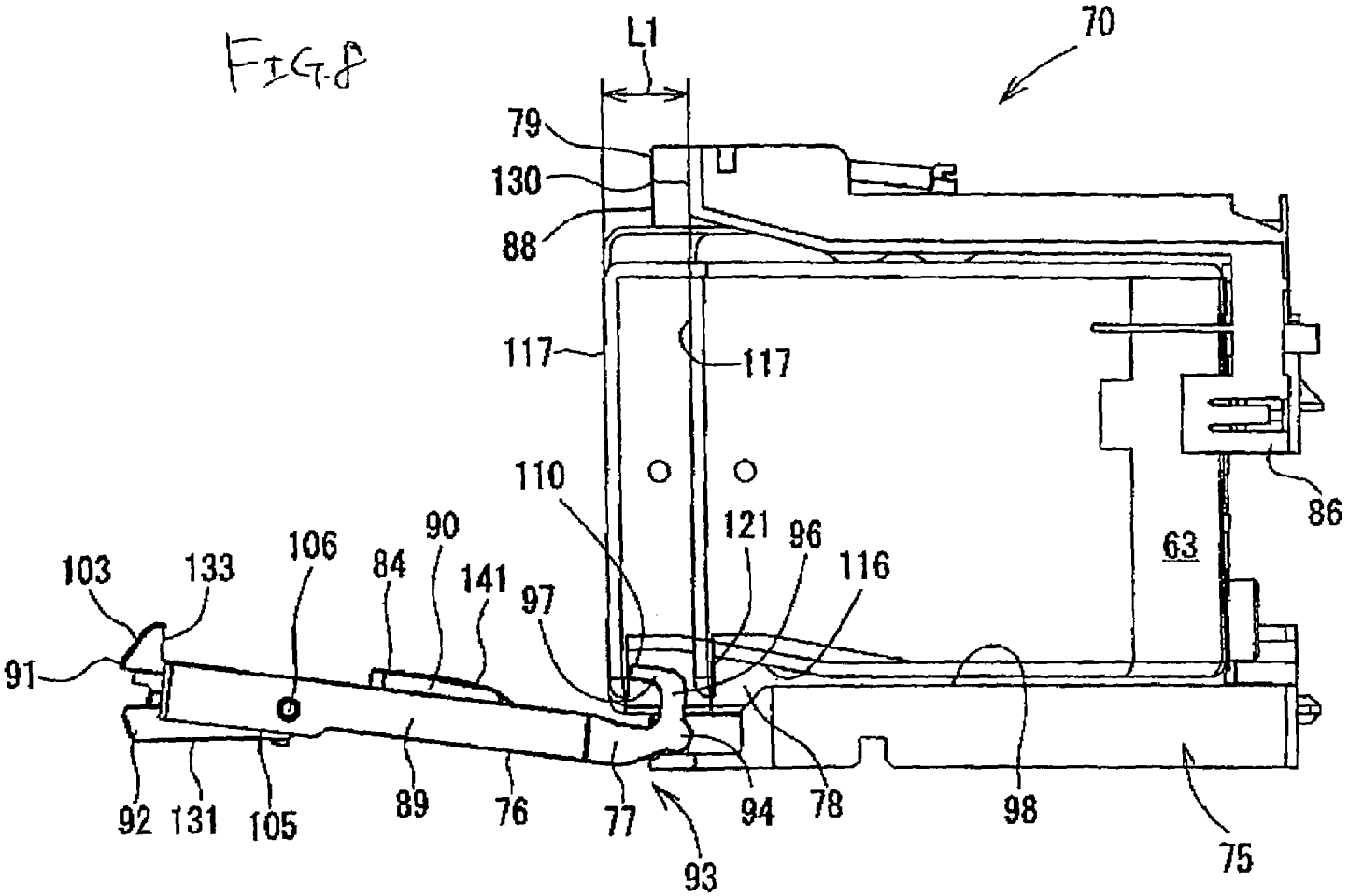
FIG. 8 is a sectional view of the unit body of the refill unit.
Figure 9:
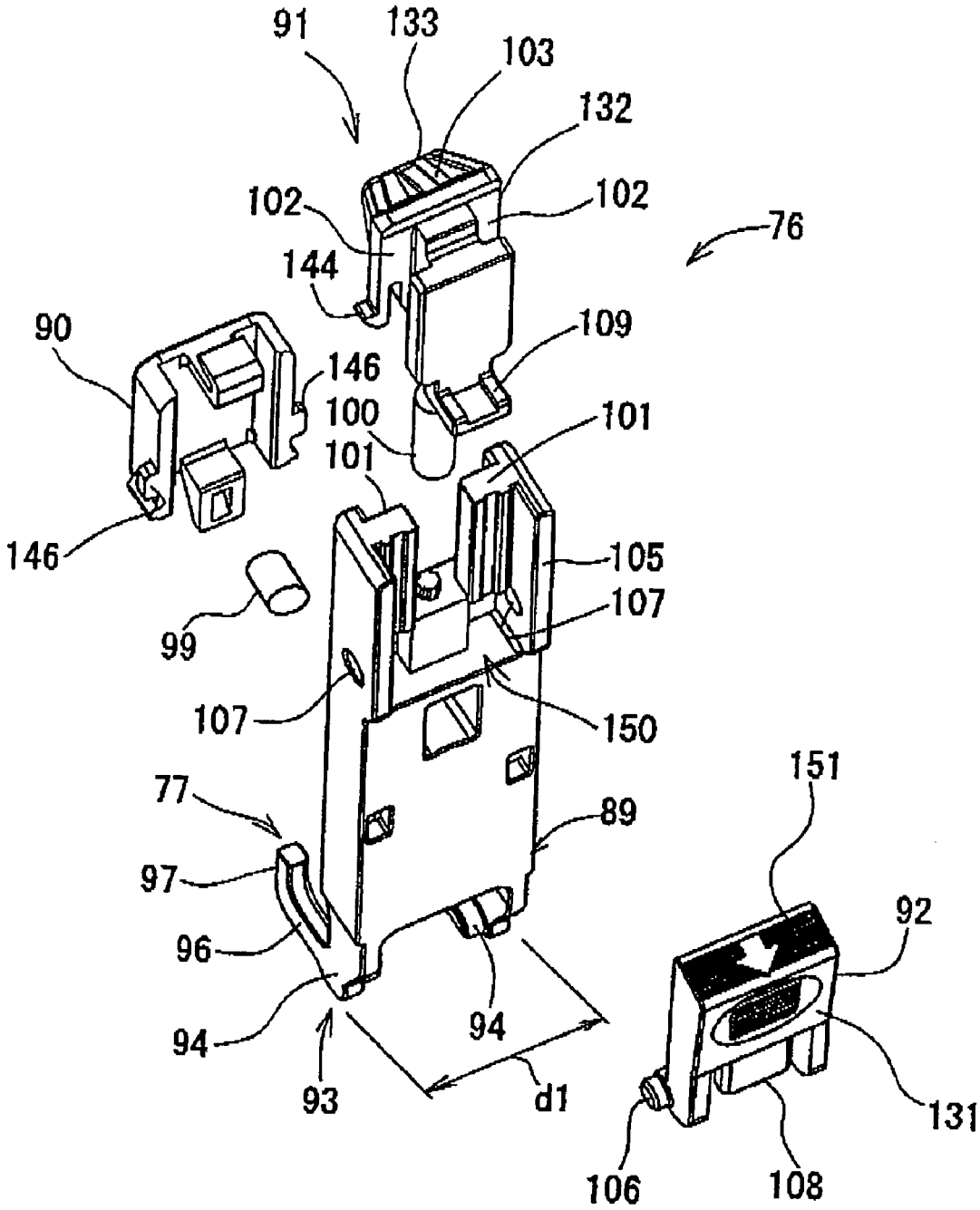
FIG. 9 is an exploded perspective view of a door of the refill unit.
Figure 10:
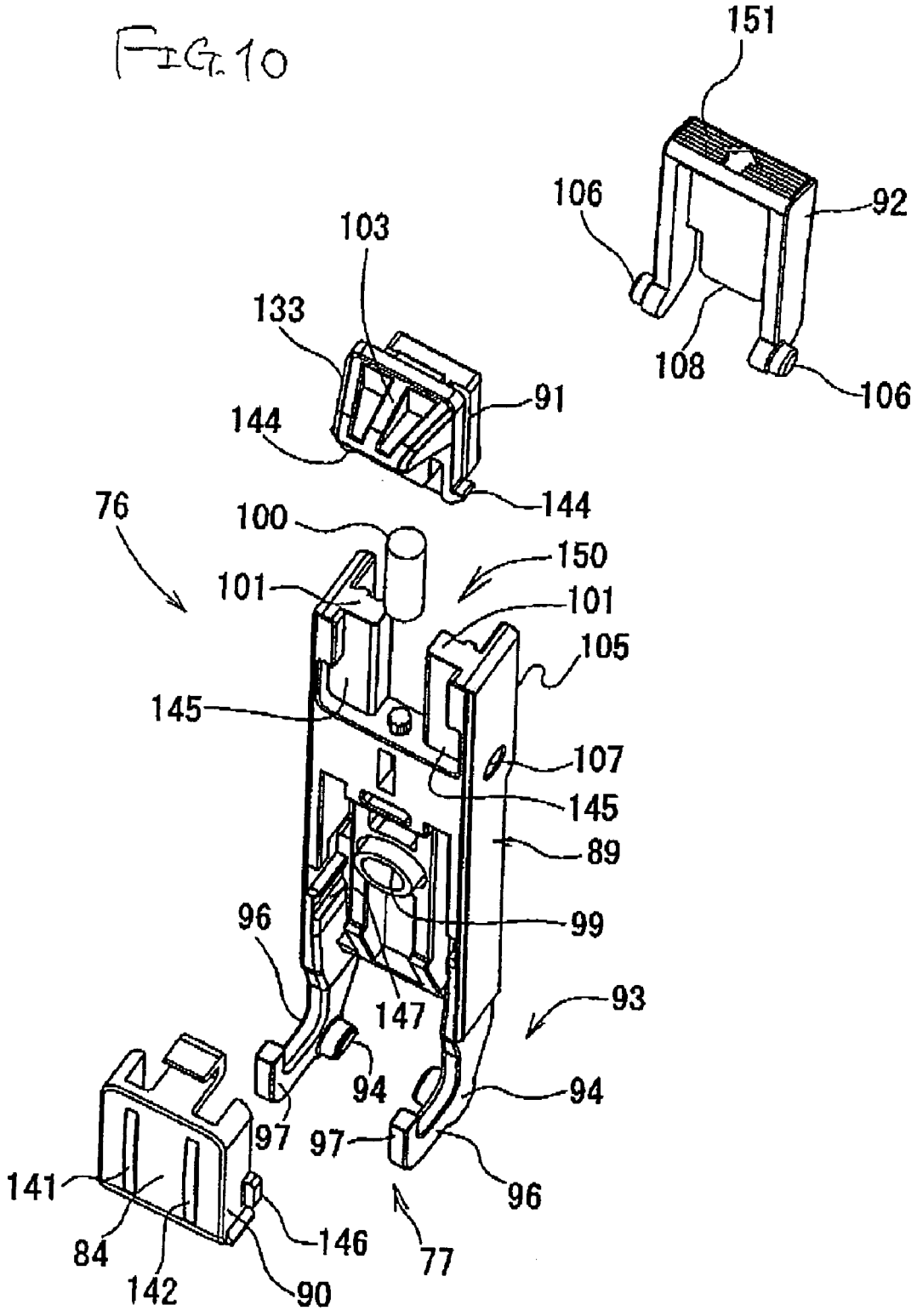
FIG. 10 is an exploded perspective view of the door of the refill unit.

FIG. 8 is a sectional view of the unit body 74 with the door 76 being opened. FIG. 9 and FIG. 10 are exploded perspective views of the door 76.

The door 76 opens and closes the opening 88. This door 76 is so attached to each opening 88 as to change between the position (or the closed position), in which it closes the opening 88, as shown in FIG. 6, and the position (or the opened position), in which it opens the opening 88, as shown in FIG. 8. The ink cartridge 63 is reliably held in the housing chamber 78, when the door 76 comes into the closed position, and can be easily inserted and extracted with respect to the housing chamber 78, when the door 76 comes into the opened position.

As shown in FIG. 5 and FIG. 6, the door 76 is provided with a door body 89, a presser holding member 90 formed in the door body 89, a locking member 91 (or a locking bar) and an unlocking lever 92, which are individually molded of resin.

As shown in FIG. 6, FIG. 9 and FIG. 10, the door body 89 is formed into an elongated rectangular plate shape. The door body 89 is contoured to match the shape of the opening 88. At the lower end portion 93 of the door body 89, there is formed a pivot portion 94. This pivot portion 94 is formed integrally with the door body 89. The pivot portion 94 is supported at the lower portion of the front face 79 of the case 75, as shown in FIG. 6. At the front end portion of the bottom plate portion 80 of the case 75. Specifically, there is formed a bearing 95, in which the pivot portion 94 is turnably fitted. This enables the door body 89 to rise thereby to close the opening 88, as shown in FIG. 6, and to fall thereby to open the opening 88, as shown in FIG. 8.

The drawer member 77 is disposed at the lower end portion 93 of the door body 89. This drawer member 77 is formed integrally with the door body 89. This drawer member 77 is generally formed into the shape of letter L to have an extending portion 96 and a bent portion 97. The extending portion 96 is formed to continue to the lower end portion 93. As shown in FIG. 6, the extending portion 96 is extended rearward from the lower end portion 93, as shown in FIG. 6, when the door 76 comes into the closed position. On the other hand, the bent portions 97 extend upward at an angle of about 90 degrees continuously from the leading end of the extending portion 96. When the door 76 comes into the closed position, the leading ends of the bent portions 97 protrude upward from the placing face 98. The door body 89 is turned on the pivot portion 94 so that the drawer member 7, as formed in the L-shaped, also turns on the pivot portion 94, as shown in FIG. 6 and FIG. 8. As the drawer member 77 is thus turned, the ink cartridge 63 is extracted out of the housing chamber 78 to the side of the opening 88 of the case 75.

When the door 76 changes to the opened position, as shown in FIG. 8, the bent portions 97 of the drawer member 77 turn counter-clockwise on the pivot portion 94. At this time, the bent portion turns so that its wall face 110 changes from the generally vertically standing state (see FIG. 6) into a substantially horizontal state (see FIG. 8). The length of the extending portion 96 of the drawer member 77 is set at a predetermined size. When the bent portions 97 are turned, therefore, its wall face 110 is positioned slight above, i.e., generally to the extension of the placing face 98 and extended in the front-rear direction. Moreover, this wall face 110 functions, when the door 76 is at the opened position, as the guide face to guide the ink cartridge 63 onto the placing face 98 in the housing chamber 78. The drawer member 77 functions not only as the member for extracting the ink cartridge 63 out of the housing chamber 78 to the side of the opening 88 but also as the guide member at the time of inserting the ink cartridge 63 into the housing chamber.

In this aspect, each door body 89 is provided with the two drawer members 77. Specifically, the individual drawer members 77 are arranged to confront each other in the widthwise direction of the door body 89, as shown in FIG. 10. The paired drawer members 77 are thus arranged to clamp and support the ink cartridge 63 in the widthwise direction. In this aspect, moreover, the distance (or the widthwise size) d1 (see FIG. 9) of the individual drawer members 77 is set smaller than the widthwise distance d2 (see FIG. 14) of the ink cartridge 63. The advantages, as attained by thus determining the sizes d1 and d2, will be described later.

As shown in FIG. 6, FIG. 8, FIG. 9 and FIG. 10, the presser holding member 90 is attached to the inner side face of the door body 89. The presser holding member 90 is provided with pawls 146 on its two side faces, and the door body 89 is provided with pawl housing portions 147. The pawls 146 are protruded from the side faces of the presser holding member 90. The pawl housing portions 147 are formed of grooves extending in the front-rear directions of the door body 89. The pawls 146 are so slidably fitted in the pawl housing portions 147 that the presser holding member 90 is supported to move back and forth in the front-rear directions with respect to the door body 89. Specifically, the presser holding member 90 can be displaced between the protruded position (see FIG. 8), in which it rises from the inner face of the door body 89, and the retracted position (see FIG. 6), in which it is retracted from that protruded position toward the door body 89. As shown in FIG. 10, a coil spring 99 is interposed between the presser holding member 90 and the door body 89. As a result, the presser holding member 90 is so elastically urged as to normally take the protruded position, as shown in FIG. 8.

The presser holding member 90 comes, when the door 76 comes into the closed position, into abutment against the front face 117 of the ink cartridge 63, as shown in FIG. 6 and is relatively pushed to the retracted position by the ink cartridge 63. Therefore, the ink cartridge 63 is pushed rearward so that the ink cartridge 63 is held in the state positioned with respect to the case 75. Therefore, the ink can be reliably prevented from leaking from the ink supply valve 115 of the ink cartridge 63.

In this aspect, the presser holding member 90 is formed in a flat plate shape. The wall face 84 (or the face to confront the front face of the ink cartridge 63 when the door 76 comes into the closed position) of the presser holding member 90 is formed into a flat face, and a pair of ridges 141 and 142 are formed on that wall face 84, as shown in FIG. 5 and FIG. 10. When the door 76 comes into the closed position, therefore, those ridges 141 and 142 abut to push the front face 117 of the ink cartridge 63. These ridges 141 and 142 are arranged at a predetermined spacing in the widthwise direction of the door 76. When the door 76 comes into the closed position, therefore, the presser holding member 90 does not come into contact with a joint portion 143 of the ink cartridge 63, but the ridges 141 and 142 contact with the two sides of the joint portion 143.

As shown in FIG. 9 and FIG. 10, the locking member 91 is attached to the upper end portion of the door body 89. The locking member 91 is provided with a main shaft portion 132, a hook portion 133 continuing to the upper end of the main shaft portion 132 and protruding to the inner side of the case 75, and a seat portion 109 continuing to the lower end of the main shaft portion 132 and protruding to the outer side of the case 75.

The locking member 91 is so supported as to move back and forth in the vertical directions with respect to the door body 89. Slide rails 101 are vertically extended on the upper end portion of the door body 89. Moreover, the locking member 91 is provided at its main shaft portion 132 with vertically extending slide grooves 102 (see FIG. 9). The slide rails 101 are inserted into those slide grooves 102 so that the locking member 91 can slide up and down.

The main shaft portion 132 is provided with pawls 144 on its two side faces. These pawls 144 protrude to the outer sides of the main shaft portion 132. When the locking member 91 is fitted in the door body 89, the pawls 144 are housed (see FIG. 10) in pawl housing portions 145 formed in the door body 89. The pawl housing portions 145 are formed of grooves vertically extending to a predetermined length. When the locking member 91 slides upward or downward, therefore, the pawls 144 abut against the inner wall faces of the pawl housing portions 145 thereby to regulate the vertical slides of the locking member 91.

By setting the length of the grooves forming the pawl housing portions 145 at the predetermined size, the slide range of the locking member 91 is regulated. When the locking member 91 slides upward with respect to the door body 89 so that the pawls 144 come into abutment against the upper edge of the inner wall face of the pawl housing portions 145, the locking member 91 comes into the position, in which it protrudes upward from the upper end of the door body 89. Herein, the position, at which the locking member 91 abuts against the upper edge of the inner wall face of the pawl housing portions 145, is called the "protruded position". When the locking member 91 slides downward with respect to the door body 89 so that the pawls 144 come into abutment against the bottom edge of the inner wall face of the pawl housing portions 145, the locking member 91 comes into the position, in which it is retracted to the inner side of the door body 89. Here, the position, in which the locking member 91 abuts against the bottom edge of the pawl housing portions 145, is called the "retracted position".

As shown in FIG. 10, a coil spring 100 (or an elastic member) is interposed between the locking member 91 and the door body 89. The locking member 91 is so elastically urged at all times in the direction to protrude upward from the door body 89, i.e., in the direction to be displaced in the protruding direction.

Moreover, the upper face 103 of the hook portion 133 of the locking member 91 is downwardly sloped. As shown in FIG. 8 and FIG. 6, therefore, the upper face 103 of the locking member 91 abuts (see FIG. 11), when the door 76 changes from the opened position to the closed position, against the upper edge portion 130 of the opening 88 of the case 75. When the door 76 is turned to the closed position, moreover, the locking member 91 is retracted, while being relatively pushed to the upper edge portion 130, to the inner side of the door body 89. When the door 76 changes the position completely to the closed position, the locking member 91 protrudes again from the door body 89, as shown in FIG. 11, so that the hook portion 133 comes into abutting engagement (see FIG. 6) with the upper edge portion 130 of the case 75.

Figure 11:
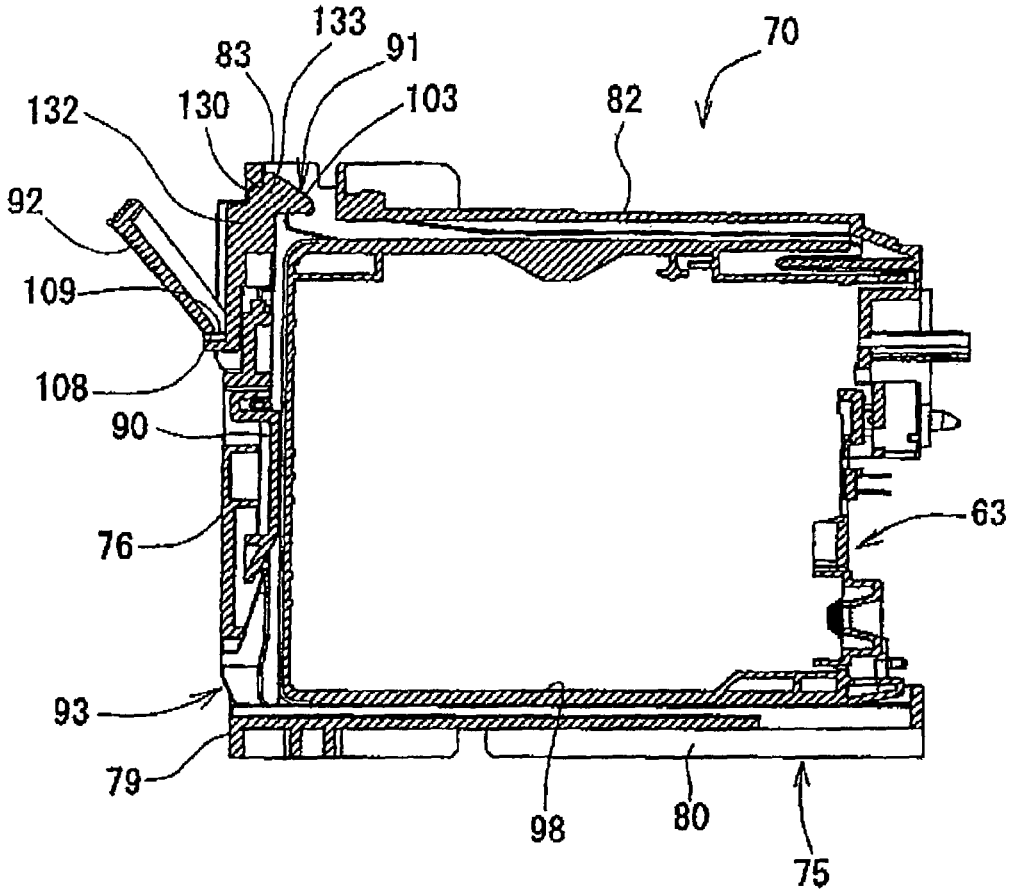
FIG. 11 is a sectional view of the refill unit.

At this time, the hook portion 133 of the locking member 91 is fitted in a locking member fitting hole formed in the case 75, as shown in FIG. 5 and FIG. 11. The locking member 91 is so elastically urged at all times by the coil spring 100 as to protrude from the door body 89, so that it is pushed to the upper edge portion 130. The position of the locking member 91 at this time is an intermediate position, which is slightly retracted toward the side of the retracted position than the protruded position. In other words, the position of the upper edge portion 130 is so determined that the locking member 91 is arranged at the intermediate portion when the hook portion 133 is fitted in the locking member fitting hole 83. The locking member 91 is elastically pushed, when it is at the intermediate position, at all times to the upper edge portion 130, so that the locking member 91 does not easily come out from the locking member fitting hole 83. As a result, the door 76 is held in the closed position, once it takes the same position.

As shown in FIG. 9 and FIG. 10, the unlocking lever 92 is formed into a rectangular plate shape, and is attached to the upper portion of an outer side face 105 of the door body 89. In this aspect, the door body 89 is provided with a housing portion 150 for housing the unlocking lever 92. This housing portion 150 is a recess formed in the door body 89, and the unlocking lever 92 is fitted, when displaced, in the housing portion 150, as will be described later.

The unlocking lever 92 is provided with support pins 106 at its lower end portion. On the other hand, the door body 89 is provided with pin supporting holes 107. As a result, the unlocking lever 92 can turn on the support pins 106. Specifically, the unlocking lever 92 can be rotationally displaced among the position, in which it rises, as shown in FIG. 6, substantially in parallel with the outer side face 105 of the door body 89, the position (see FIG. 11), in which it is inclined by about 45 degrees, and the position (see FIG. 12), in which it falls substantially horizontal.

The unlocking lever 92 is inserted, as it rises, into the housing portion 150 of the door body 89. The unlocking lever 92 becomes, as it is housed in the housing portion 150, generally parallel to the outer side face 105 of the door body 89. In other words, the front face 131 of the unlocking lever 92 extends substantially along the front face 79 of the case 75. The position of the unlocking lever 92 at this time is called the "housed position". The position of the unlocking lever 92 at the time when the unlocking lever 92 is inclined about 45 degrees is called as the "neutral position". The position of the unlocking lever 92 having fallen generally horizontally is called as the "fallen position". Here, an arrow is displayed or engraved in the upper face 151 of the unlocking lever 92. As a result, the operation direction of the unlocking lever 92 is clarified.

The lower end portion (or the predetermined portion) of the unlocking lever 92 is formed into a predetermined external shape. This lower end portion 108 constitutes an interlocking cam for sliding the locking member 91 upward and downward when the unlocking lever 92 changes its position. The locking member 91 slides from the protruded position through the intermediate position to the retracted position, when the unlocking lever 92 is turned from the housed position through the neutral position to the fallen position by providing the interlocking cam 108. In other words, the unlocking lever 92 is arranged in the housed position, when the locking member 91 is at the protruded position. When the door 76 is closed, as described hereinbefore, so that the locking member 91 is abutting against the upper edge portion 130 of the case 75, the unlocking lever 92 can be freely displaced between the housed position (see FIG. 6) and the neutral position (see FIG. 11). At this time, the unlocking lever 92 has its center of gravity set such that it is always displaced to the neutral position by its own weight.

Figure 12:
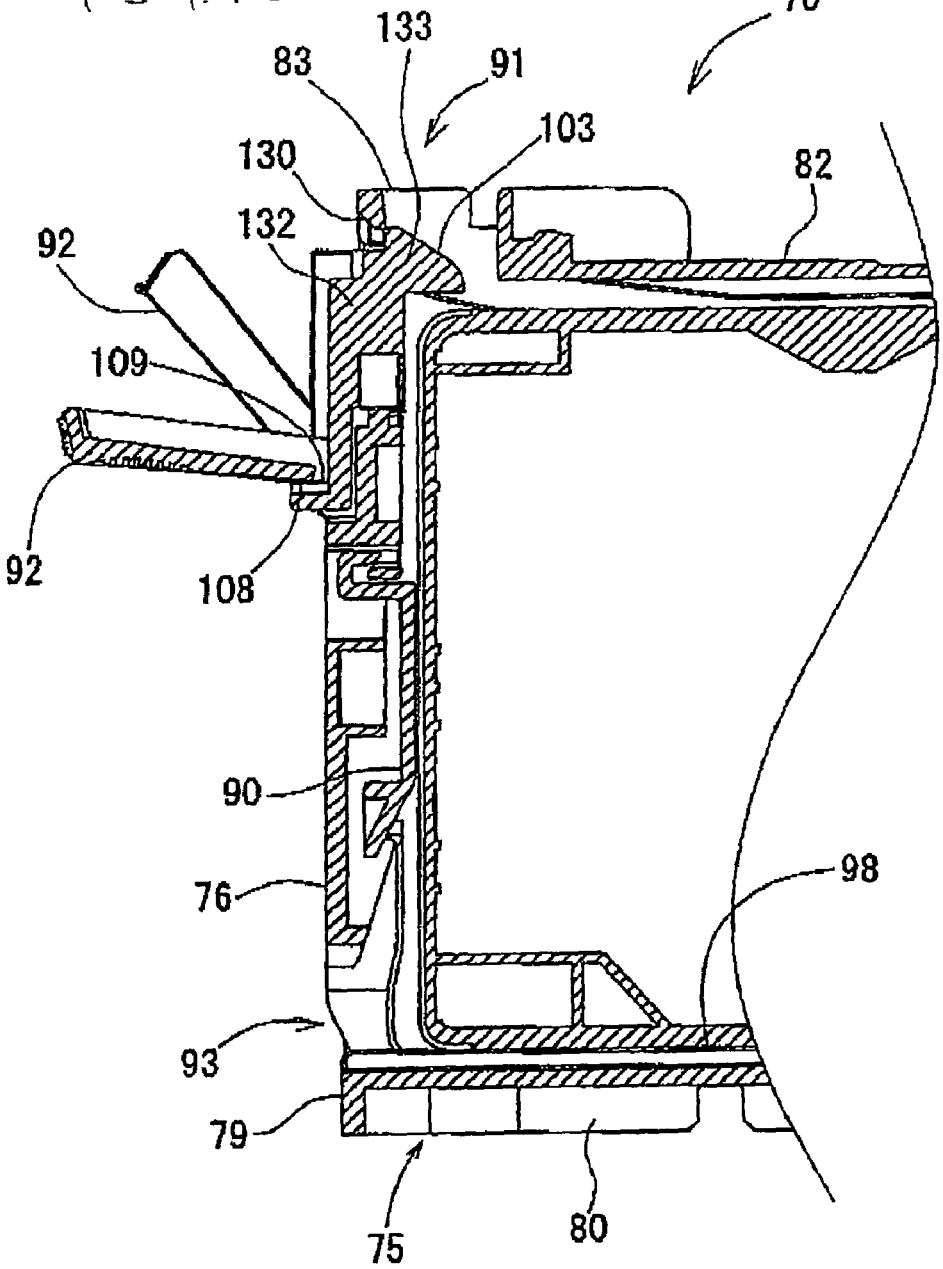
FIG. 12 is an enlarged view of an essential portion of FIG. 11.

FIG. 11 is a sectional view of the refill unit 10 and shows the actions of the unlocking lever 92. FIG. 12 is an enlarged view of FIG. 11.

The interlocking cam 108 of the unlocking lever 92 abuts against the seat portion 109 of the locking member 91. When the door 76 is closed (see FIG. 11), the unlocking lever 92 tries to further turn counter-clockwise by its own weight. Specifically, the unlocking lever 92 turns the locking member 91 further downward through the interlocking cam 108. However, the locking member 91 is elastically urged upward at all times by the coil spring 100, so that the locking member 91 is not displaced further by the action of the weight of the unlocking lever 92 so that the locking member 91 is kept at the intermediate position.

In case the unlocking lever 92 is further forcibly turned counter-clockwise, as shown in FIG. 12, or in case the operator operates the unlocking lever 92 to turn the ink cartridge 63, for example, the unlocking lever 92 is turned and displaced to the fallen position. When the unlocking lever 92 is displaced to the fallen position, the interlocking cam 108 is turned and displaced on the support pins 106 thereby to depress the seat portion 109 of the locking member 91. As a result, the locking member 91 moves downward against the elastic force of the aforementioned coil spring 100 so that it is displaced to the retracted position. When the locking member 91 is displaced to the retracted position, the door 76 is unlocked so that it can change from the closed position to the opened position.

Here, the locking member 91 is always receiving the elastic force of the coil spring 100. When the turning force to act on the unlocking lever 92 disappears, that is, when the operator releases the unlocking lever 92, the locking member 91 takes the position, in which it is protruded the most from the door body 89. At this time, the unlocking lever 92 is forcibly displaced to the housed position. When the door is in the opened position, as shown in FIG. 8, the unlocking lever 92 comes into the position, in which it is substantially housed in the door body 89. In case the ink cartridge 63 is replaced, as shown in FIG. 1, FIG. 5 and FIG. 8, therefore, the unlocking lever 92 is substantially housed in the door body 89. As a result, the unlocking lever 92 can turn on the pivot portion 94 till the door 76 takes a substantially horizontal state, so that the operator can replace the ink cartridge 63 easily. Moreover, the two ridges 141 and 142, as disposed on the wall face 84 of the pivot portion 94, can act as such a guide with the guide portion between the later-described bent portions 97 as to house the ink cartridge 63 in the housing chamber 78. Specifically, when the ink cartridge 63 is inserted into the housing chamber 78, the operator may put the bottom face of the ink cartridge 63 on the ridges 141 and 142, and may place the leading end portion of the ink cartridge 63 between the bent portions 97 thereby to push the ink cartridge 63 as it is into the housing chamber 78. When the ink cartridge 63 is extracted from the housing chamber 78, the operator may extract the bottom face of the ink cartridge 63 from between the bent portions 97 to the ridges 141 and 142.

When the multifunction device 10 is in the ordinary use state, the door 76 of the refill unit 70 is closed, and the unlocking lever 92 is arranged at the neutral position. When the opening/closing cover 72 is opened at the ink cartridge replacing time, as shown in FIG. 1, the unlocking lever 92 is inclined toward the operator side. As a result, it is advantageous that the operator can operate the unlocking lever 92 easily. Here, the refill unit 70 is arranged in the front face 71 of the multifunction device 10, as shown in FIG. 1. If the unlocking lever 92 is arranged at the neutral position, that is, inclined on the front face, a wide space for housing the refill unit 70 has to be retained in the multifunction device 10. Therefore, the refill unit 70 has to be arranged deeply of the peripheral edge of the opening 73, and the exterior sizes of the multifunction device 10 may be enlarged.

In this aspect, on the other hand, the unlocking lever 92 can freely turn, when the door 76 takes the closed position with respect to the case 75, between the neutral position and the housed position, so that the refill unit 70 can be arranged in the vicinity of the peripheral edge of the aforementioned opening 73'. Even if the refill unit 70 is arranged on the peripheral edge of that opening 73, the opening/closing cover 72 abuts at its inner wall face, when it is closed, against the unlocking lever 92. When the opening/closing cover 72 is completely closed, the unlocking lever 92 is displaced, while being pushed by the opening/closing cover 72, to the housed position. In this aspect, therefore, it is possible to design the multifunction device 10 compactly.

Figure 13:
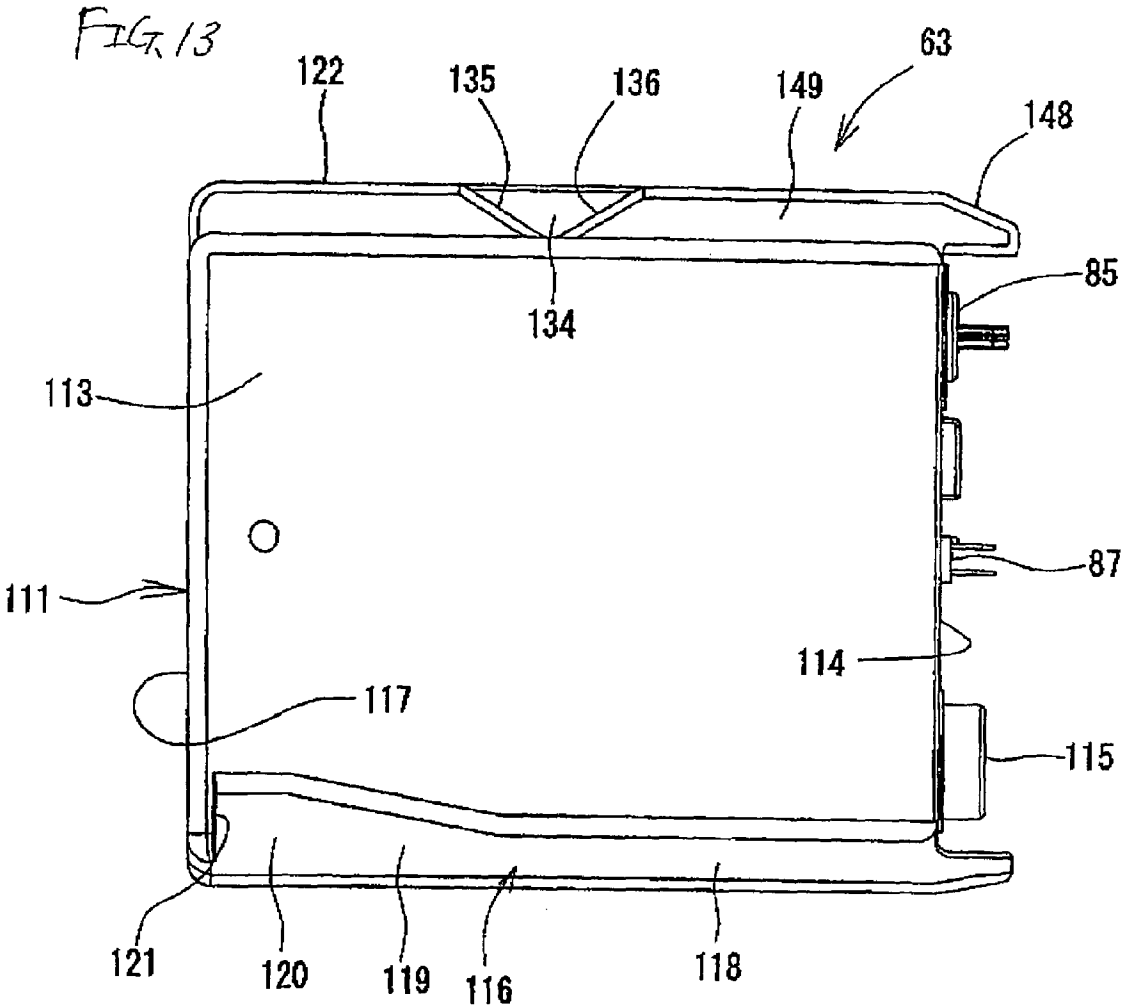
FIG. 13 is a side elevation of an ink cartridge.
Figure 14:
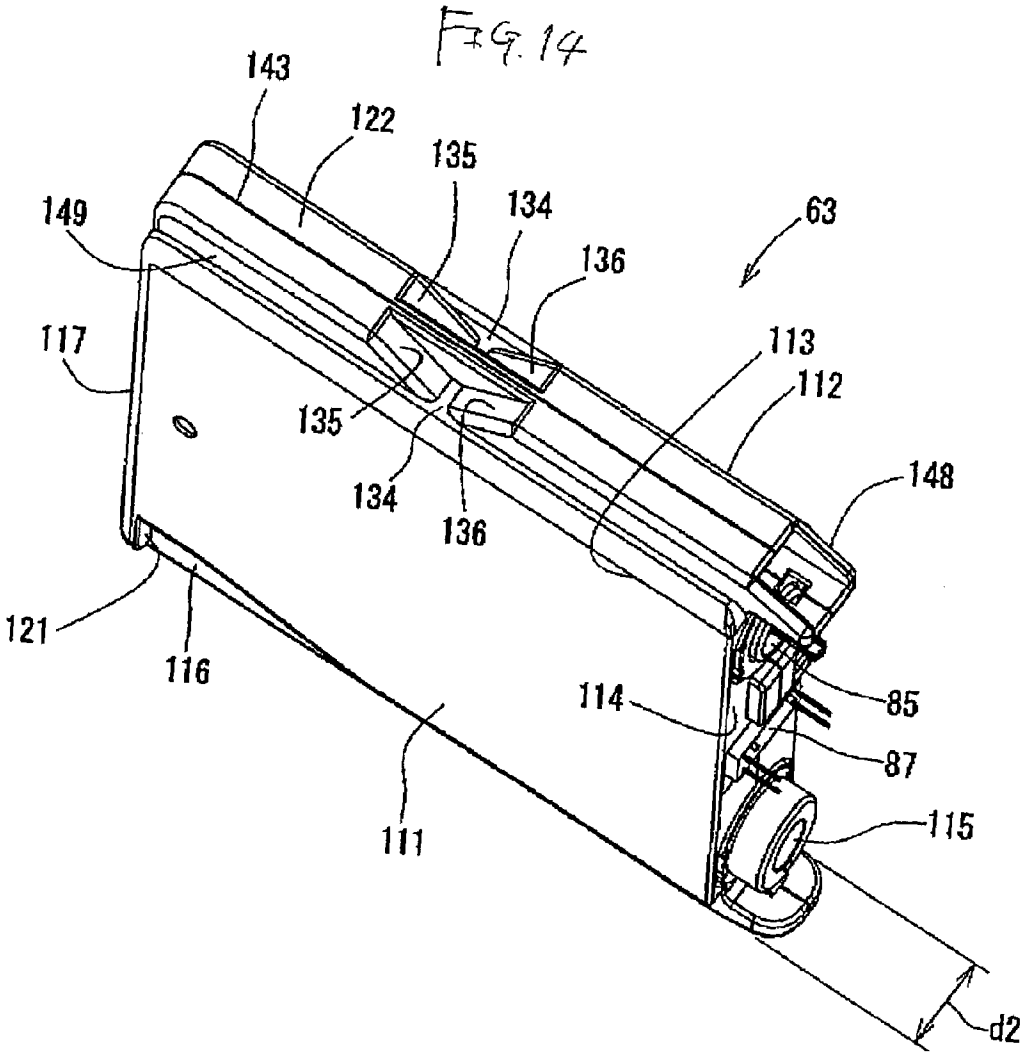
FIG. 14 is a perspective view of the ink cartridge.

FIG. 13 is a side elevation of the ink cartridge 63. FIG. 14 is a perspective view of the ink cartridge 63.

The ink cartridge 63 is provided, for reserving the ink in advance, as described hereinbefore, with a cartridge body 111, and the ink reserved in the body. In this aspect, the refill unit 70 houses the four ink cartridges 63, which contain inks of individual colors of cyan, magenta, yellow and black. The structures of the individual ink cartridges 63 are made such that only the ink cartridge 63 for reserving the black ink is made slightly larger in the thickness direction than the ink cartridges 63 of the remaining ink colors. This is because the black ink is generally the most demanded and is heavily consumed. Here, all the ink cartridges 63 for reserving the inks of the colors other than black are similar.

The cartridge body 111 is made of resin. In this aspect, the cartridge body 111 is wholly formed into a thin box shape defining an ink reserving space for reserving the ink inside. This cartridge body 111 is composed of two tray-shaped members 112 and 113, which are jointed by fusing or well-known fixing method. The aforementioned joint portion 143 is formed by jointing the cartridge body 111.

The cartridge body 111 is provided on its back 114 with the air introduction valve 85. In this aspect, a check valve is arranged deeply in the air introduction valve 85. When the ink cartridge 63 is housed in the case 75, the push rod, as disposed at the case 75, is inserted into the air introduction valve 85 so that the check valve is opened. Moreover, the ink supply valve 115 is disposed on the back 114 of the cartridge body 111. When the ink cartridge 63 is housed in the case 75, the ink supply pipe, as disposed at the case 75, is connected to that ink supply valve 115 so that the ink is fed through the ink supply pipe to the aforementioned recording head 27. Moreover, the back 114 is provided with the liquid level sensor 87. The structure of this liquid level sensor 87 is not specifically limited, but can adopt a known sensor.

In the lower face of the cartridge body 111, a fitting groove 116 is formed. This fitting groove 116 is formed in the corner of the boundary between the side face and the bottom face of the cartridge body 111, as shown in FIG. 14. This fitting groove 116 is extended in the longitudinal direction of the cartridge body 111, as shown in FIG. 14. In this aspect, the fitting groove 116 is formed (see FIG. 5) symmetrically in each of the two right and left sides of the cartridge body 111. As shown in FIG. 13, this fitting groove 116 includes a shallow groove portion 118, which is opened in the back 114 of the cartridge body 111 and extending continuously from the back 114 toward the front face 117, a boundary groove portion 119 continuing to that shallow groove portion 118 and becoming gradually deeper (in the vertical size in FIG. 13), and a deep groove portion 120 continuing from that boundary groove portion 119. This deep groove portion 120 does not continue to the front face 117 of the cartridge body 111. An end face 121 is formed on the side of the front face 117 of the deep groove portion 120. In other words, the fitting groove 116 extends in the directions, in which the ink cartridge 63 is inserted into and extracted from the case 75, and leads to the back 114 of the cartridge body 111 but not to the front face 117. The fitting groove 116 has the vertically extending end face 121. Against this end face 121, moreover, there abuts the leading end of the bent portion 97 of the drawer member 77, as will be described later.

In the upper face 122 of the cartridge body 111, there is also formed a groove 149. As shown in FIG. 14, this groove 149 is recessed in the corner of the boundary between the side face and the upper face 122 of the cartridge body 111. As shown, this groove 140 so extends in the longitudinal direction of the cartridge body 111 as to lead to the front face 117 and the back 114 of the cartridge body 111. In the upper face 122 of the cartridge body 111, moreover, there is formed a recess 134. This recess 134 is generally formed into a V-shape, which is composed of a front slope 135 and a rear slope 136. As shown in FIG. 6 and FIG. 7, the case 75 for housing the ink cartridge 63 is provided with the aforementioned swing arm 123, which is elastically urged to turn clockwise by the tension spring 128.

When the ink cartridge 63 is inserted into the case 75, the upper face rear end portion 148 of the cartridge body 111 comes at first into abutment against the second arm 126 of the swing arm 123, as shown in FIG. 7. When the ink cartridge 63 is inserted into the case 75, the swing arm 123 is turned counter-clockwise to the position, as indicated by solid lines in FIG. 7. When the ink cartridge 63 is further inserted, the swing arm 123 turns clockwise, while being guided by the rear slope 136, into the recess 134. When the ink cartridge 63 is housed in the case 75, the second arm 126 of the swing arm 126 turns again counter-clockwise, while being guided by the front slope 135, into the position indicated by solid lines in FIG. 7. As the ink cartridge 63 is inserted into the case 75, moreover, the ink cartridge 63 slides relative to the swing arm 123. When the ink cartridge 63 is arranged at the position which is spaced by a predetermined distance to the right side from the position indicated by the solid lines in FIG. 7, the ink cartridge 63 is completely housed in the case 75. The predetermined distance of this case is a distance L1, as shown in FIG. 8.

Figure 15A:
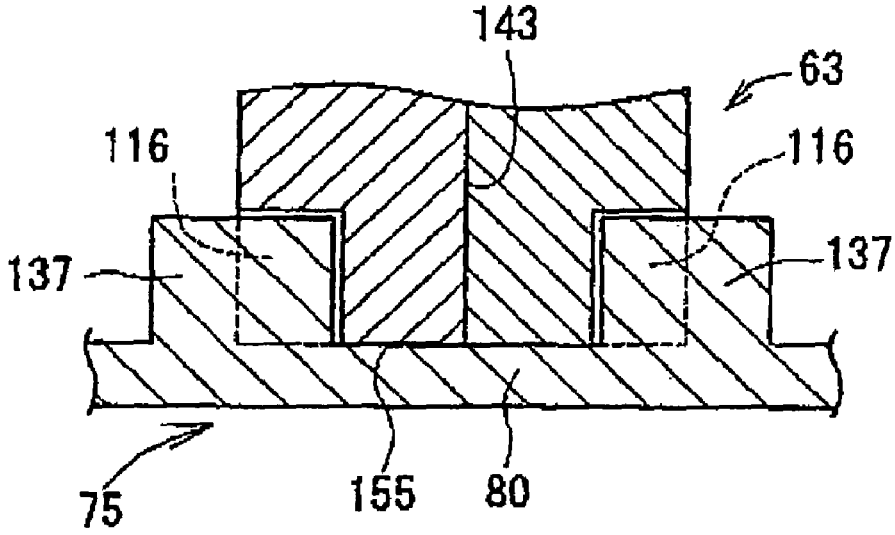
FIGS. 15A and 15B are diagrams schematically showing a fitting structure of the ink cartridge, case and drawer member.
Figure 15B:
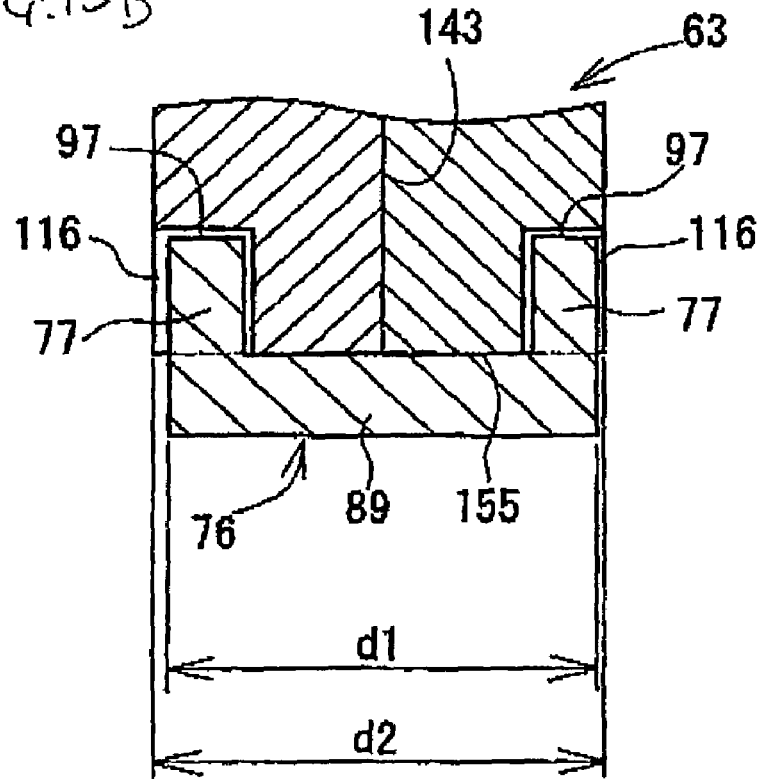

FIGS. 15A and 15B are diagrams schematically showing the fitting structures of the ink cartridge 63, and the case 75 and the drawer member 77 of the door 76. FIG. 15A shows the fitting structure between the lower portion of the ink cartridge 63 and the lower portion of the case 75, and FIG. 15B shows the fitting structure between the ink cartridge 63 and the drawer member 77.

When the ink cartridge 63 is housed in the case 75, as shown in FIG. 15A, the partition 137 of the case 75 is fitted in the fitting groove 116 of the ink cartridge 63. When the ink cartridge 63 is housed in the case 75, the partition 137, as disposed on the side of the top plate portion 82 of the case 75, is also fitted in the groove 149, which is disposed in the side of the upper face 122 of the ink cartridge 63. At this time, the lower face 155 of the ink cartridge 63 is placed on the bottom plate portion 80. As a result, the ink cartridge 63 is so housed and held as is positioned in the case 75 (see FIG. 6). When the ink cartridge 63 is housed in the case 75, the lower face 155 of the ink cartridge 63 is placed, as shown in FIG. 15E, on the door body 89, so that the bent portion 97 of the drawer member 77 proceeds into the fitting groove 166. When the door 76 is opened from this state, the drawer member 77 turns, as shown in FIG. 6 and FIG. 7, so that the bent portion 97 pulls the end face 121 of the fitting groove 116 forward (or leftward of FIG. 7).

Figure 16A:
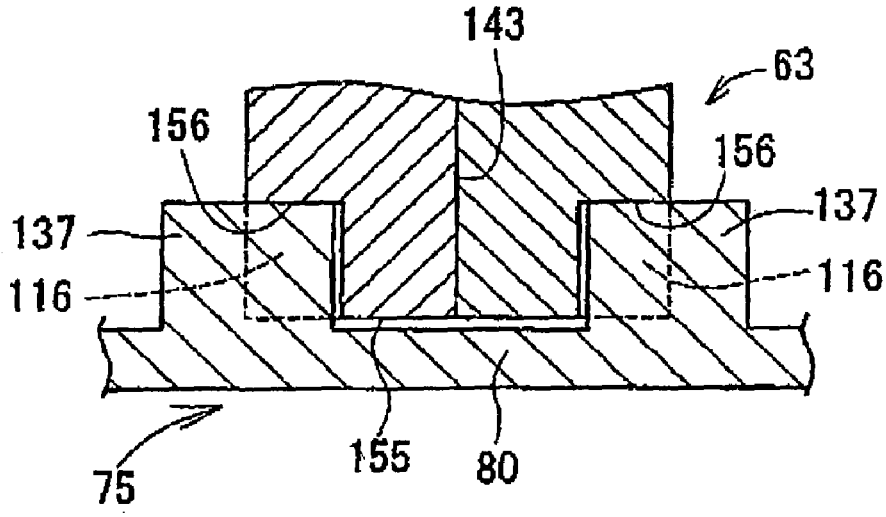
FIGS. 16A and 16B are diagrams schematically showing a modification of the fitting structure of the ink cartridge, case and drawer member.
Figure 16B:
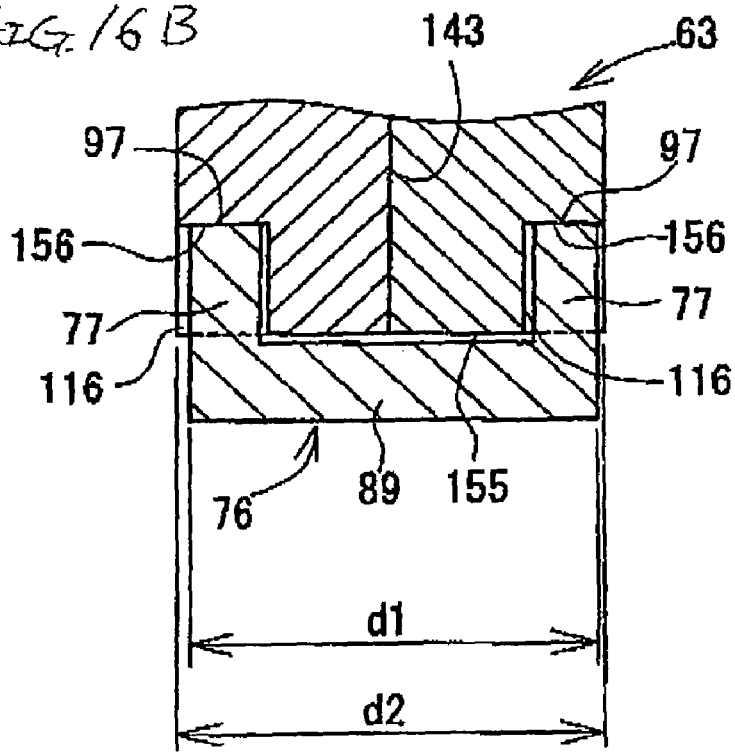

The fitting structures between the ink cartridge 63, and the case 75 and the drawer member 77 of the door 76 should not be limited to the aforementioned ones. FIGS. 16A and 16B are diagrams schematically showing a modification of the fitting structure between the ink cartridge 63, and the case 75 and the drawer member 77 of the door 76. FIG. 16A shows the fitting structure between the lower portion of the ink cartridge 63 and the lower portion of the case 75, and FIG. 16A shows the fitting structure between the ink cartridge 63 and the drawer member 77.

What the fitting structure shown in FIGS. 16A and 16B is different from that shown in FIGS. 15A and 15B is that, when the ink cartridge 63 is housed in the case 75, the lower face 155 of the ink cartridge 63 is placed on the bottom plate portion 80 (see FIG. 15A) and on the door body 89 (see FIG. 15B). In the fitting structure shown in FIGS. 16A and 16B, on the contrary, when the ink cartridge 63 is housed in the case 75, the lower face 155 of the ink cartridge 63 does not contact with the bottom plate portion 80, but the upper wall face 156 of the fitting groove 116 is brought into abutment against the partition 137 (see FIG. 16B). At this time, as shown in FIG. 16B, the lower face 155 of the ink cartridge 63 does not contact with the door body 89, but the upper wall face 156 is placed on the bent portion 97 of the drawer member 77, so that the bent portion 97 proceeds into the fitting groove 116. In this modification, too, the ink cartridge 63 is so housed and held as is positioned in the case 75. When the door 76 is opened, moreover, the drawer member 77 turns, as shown in FIG. 6 and FIG. 7, so that the bent portion 97 pulls the end face 121 of the fitting groove 116 forward (or leftward of FIG. 7).

Figure 17A:
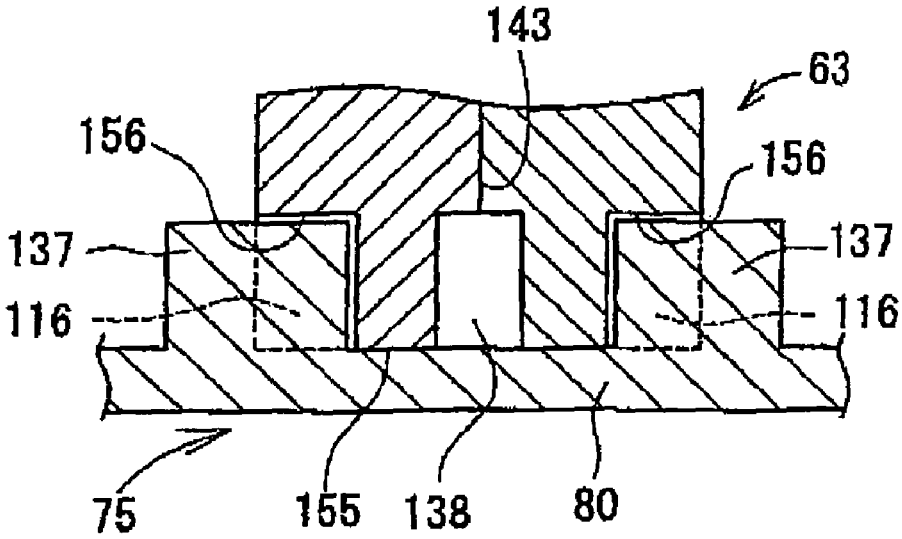
Figure 17B:
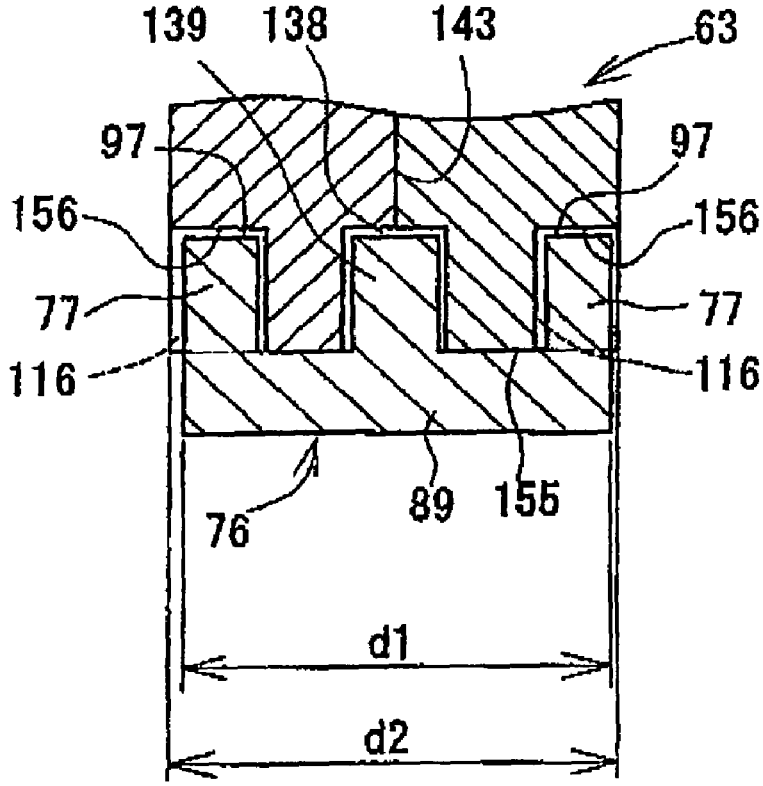

FIGS. 17A and 17B are diagrams schematically showing another modification of another fitting structure between the ink cartridge 63, and the case 75 and the drawer member 77 of the door 76. FIG. 17A shows the fitting structure between the lower portion of the ink cartridge 63 and the lower portion of the case 75, and FIG. 17B shows the fitting structure between the ink cartridge 63 and the drawer member 77.

What the fitting structure shown in FIGS. 17A and 17B is different from that shown in FIGS. 15A and 15B is that, when the ink cartridge 63 is housed in the case 75, the lower face 155 of the ink cartridge 63 is placed on the bottom plate portion 80 (see FIG. 15A) and on the door body 89 (see FIG. 15B). In the fitting structure shown in FIGS. 17A and 17B, the ink cartridge 63 is provided in its lower face 155 with a groove 138. This groove 138 extends in the same direction as that of the fitting groove 116. On the door body 38, moreover, there is formed a ridge 139, which is fitted in that groove 138. This ridge is also extended in the same direction as the fitting groove 116 and is fitted in the groove 138. When the ink cartridge 63 is housed in the case 75, the lower face 55 of the ink cartridge 63 is placed on the bottom plate portion 80 and on the door body 89 so that the bent portion 97 of the drawer member 77 proceeds into the fitting groove 116.

When the door 76 is opened from this state, the drawer member 77 is turned, as shown in FIG. 6 and FIG. 7, so that the bent portion 97 pulls the end face of the fitting groove 116 forward (or leftward of FIG. 7). Since the ridge 139 is formed on the door body 89, it is fitted in the groove 138 formed in the ink cartridge 63. When the door 76 is opened, the ink cartridge 63 is so stably extracted from the case 75 as does not fall down. As a result, the extracting operation of the ink cartridge 63 is smoothly performed.

In the multifunction device 10 according to this aspect, the used ink cartridge is replaced in the following manner.

First of all, when the door 76 is closed with the ink cartridge 63 being housed in the case 75, as shown in FIG. 11, the locking member 91 slides to the protrusion position side thereby to abut against the upper edge portion 130 of the case 75. In short, the locking member 91 is displaced to the intermediate position, and the door 76 is locked in the closed position. When the door 76 is in the closed position, the unlocking lever 92 can be freely displaced from the neutral position to the housed position. At this time, the inner wall face of the opening/closing cover 72 abuts against the unlocking lever 92, when the opening/closing cover 72 is closed. When the opening/closing cover 72 is completely closed, the unlocking lever 92 is displaced, while being pushed by the opening/closing cover 72, to that housed position. In short, the exterior sizes of the refill unit 70 are reduced by the closure of the opening/closing cover 72. In this aspect, therefore, it is possible to design the multifunction device 10 compactly.

In order to extract the ink cartridge 63 from the multifunction device 10, the operator opens the opening/closing cover 72, as shown in FIG. 1. As a result, the refill unit 70 is exposed to the front face of the multifunction device 10. In this aspect, when the opening/closing cover 72 is opened, the unlocking lever 92 of the refill unit 70 is displaced from the housed position to the neutral position, so that it is inclined to the front side of the multifunction device 10, as shown in FIG. 1. When the unlocking lever 92 is at the neutral position, it is inclined away from the front face 79 of the case 75 so that the operator can operate the unlocking lever 92 easily. Specifically, the operator can touch the unlocking lever 92, which is inclined to this side from the front face 79 of the case 75, easily with the fingers, and can turn the unlocking lever 92 simply to the fallen position.

In this state, the operator opens the door 76 of the refill unit 70. Specifically, the operator pushes down the unlocking lever 92 to this side with the fingers thereby to displace the unlocking lever 92 to the fallen position. As a result, the locking member 91 of the door 76 slides downward so that the hook portion 133 (see FIG. 12) of the locking member 91 comes out of engagement with the locking member fitting hole 83 of the door 76. The operator can open the door 76, as shown in FIG. 1, by pulling the unlocking lever 92 to the side of the operator, and can extract the ink cartridge 63 in that state.

When the door 76 is opened so that the fingers of the operator leave the unlocking lever 92, the locking member 91 is shifted to the protruded position, so that the unlocking lever 92 is accordingly displaced to the housed position. When the unlocking lever 92 is displaced to the housed position, the unlocking lever 92 is fitted in the housing portion 150 so that it extends substantially along the front face 79 of the case 75. When the door 76 is completely opened, the front face 131 of the unlocking lever 92 comes into abutment against the opening/closing cover 72 (see FIG. 1), as shown in FIG. 7, so that the door 76 becomes generally horizontal. As a result, the operations to insert and extract the ink cartridge 63 into and out of the case 75 are more simplified.

In this aspect, the door 76 holds the locking member 91 in a slidable state. Specifically, the slide rails 101 of the door body 89 guide the slide of the locking member 91. Therefore, the advantage is that the locking member 91 can slide smoothly. Moreover, the locking member 91 is always urged to the side of the protruded position by the coil spring 100, it slides to the side of the protruded position, simultaneously as the door 76 is closed, and abuts at the intermediate position against the case 75. While the locking member 91 is at the intermediate position, moreover, it is held at the intermediate position while receiving a constant elastic force from the coil spring 100. As a result, the locking member 91 reliably engages with the case 75 so that the door 76 is locked in the closed position. As a result, the operations to replace the ink cartridges, especially, the operations to close the door 76 thereby to house the ink cartridge 63 in the case 75 are made simpler and more reliable.

In this aspect, moreover, the unlocking lever 92 is provided with the interlocking cam 108, which displaces the locking member 91 in association with the turning motion of the unlocking lever 92. Therefore, the structure for displacing the locking member 91 is remarkably simplified to give a result that the exterior sizes of the case 75 and accordingly the exterior sizes of the refill unit 70 are reduced.

By the interlocking actions between the locking member 91 and the unlocking lever 92, on the other hand, the unlocking lever 92 is automatically displaced, when the locking member 91 is at the protruded position, to the housed position by the urge of the coil spring 100. Even if, therefore, the door 76 is opened and felled down, the door 76 still takes the generally horizontal position. When the door 76 is opened in the substantially horizontal state, the inserting/extracting operations of the ink cartridge 63 are facilitated, as described hereinbefore.

When the door 76 changes from the closed position to the opened positions, the drawer member 77 turns on the pivot portion 94, as shown in FIG. 8, so that the bent portion 97 abuts against the end face 121 of the ink cartridge 63 and pushes it leftward of the drawing (to this side of the front face in FIG. 1). As a result, the ink cartridge 63 is so pulled by a predetermined distance L1 to this side from the opening 88 of the case 75 as to be scraped out to the side of the opening 88. As a result, the operator can grip the ink cartridge 63 easily and can pull it out easily from the opening 88.

Next, a new ink cartridge 63 is inserted from the opening 88 into the housing chamber 78 of the case 75. At this time, the door 76 is in the opened position, and the ink cartridge 63 to be inserted into the housing chamber 78 is placed in advance on the wall face 110 of the bent portion 97 of the drawer member 77, and is inserted, while being guided by the wall face 110, into the housing chamber 78. Especially in this aspect, the door 76 is provided with the presser holding member 90 so that the new ink cartridge 63 is once placed on the ridges 141 and 142 mounted on the wall face 84 of the presser holding member 90 and is guided, while being slid on the ridges 141 and 142, on the wall face 110 of the bent portion 97. With the new ink cartridge 63 being housed in the case 75, moreover, the operator again changes the door 76 into the closed position. When the door 76 changes into the closed position, the presser holding member 90 abuts against the front face 117 of the ink cartridge 63. When the door 76 comes into the completely closed position, the presser holding member 90 elastically urges the ink cartridge 63 deeply into the inside of the housing chamber 78 of the case 75. Simultaneously with this, the hook portion 133 of the locking member 91 is fitted in the locking member fitting hole 83 formed in the case 75, so that the door 76 is held in the closed position.

The multifunction device 10 according to this aspect has the following additional advantages.

In this aspect, the operation is enabled to extract the used ink cartridge 63 automatically merely by opening the door 76 of the refill unit 70, and to house the new ink cartridge 63 easily in the case 75 while leaving the door 76 open. In short, the replacing operations of the ink cartridge 63 are remarkably simple.

In this aspect, moreover, the top plate portion 82 of the case 75 is equipped with the swing arm 123, as shown in FIG. 7. With the ink cartridge 63 being extracted by the aforementioned distance L1 from the case 75, the swing arm 123 presses the front slope 135. Specifically, the elastic force of the tension spring 128 acts through the wing arm 123 upon the front slope 135 of the cartridge body 111, so that the ink cartridge 63 is elastically urged to the aforementioned opening 86. Simultaneously as the door 76 is opened so that the ink cartridge 63 is extracted from the opening 88 of the case 75 by the drawer member 77, the swing arm 123 turns clockwise in FIG. 7 thereby to push the front slope 135 to the opening 88. As a result, the swing arm 123 fits in the recess 134 formed between the front slope 135 and the rear slope 136, so that its second arm 126 abuts against the rear slope 136. In short, the swing arm 123 is held in the recess 134.

The swing arm 123 turns to fit in the recess 134 so that the ink cartridge 63 is further pushed by a distance L2 from the case 75. As a result, the ink cartridge 63 is pushed out by the aforementioned distance (L1+L2) from the aforementioned opening 88. This raises an advantage that the operator can grip the used ink cartridge 63 remarkably easily to take it out of the case 75 more simply.

Moreover, the aspect is provided with the paired drawer members 77, which clamp the ink cartridge 63 arranged in the housing chamber 78, in the widthwise direction (see FIG. 15). As a result, the ink cartridge 63 is extracted, while being widthwise positioned by the drawer member 77, from the aforementioned opening 88. At this time, as shown in FIG. 7 and FIG. 8, the bent portion 97 of the drawer member 77 is arranged so substantially horizontally as to continue smoothly to the placing face 98, on which the ink cartridge 63 is placed. When the new ink cartridge is inserted from the opening 88 into the housing chamber 78, therefore, the new ink cartridge is reliably supported on the drawer member 77, once it is placed on the wall face 110 of the bent portion 97, so that it is guided as it is on the placing face. Therefore, the operator can perform the ink cartridge replacing operations more easily.

Moreover, each drawer member 77 is fitted in the fitting groove 116 recessed in the ink cartridge 63. The widthwise size d1 (see FIG. 9) of the paired drawer members 77 is set smaller than the widthwise size d2 (see FIG. 14) of the ink cartridge 63 so that the drawer member 77 does not protrude from the ink cartridge 63. By setting the size d1 equal to or smaller than the size d2, the door 76 is designed compactly to realize the size reduction of the refill unit 70 and accordingly the size reduction of the multifunction device 10.

Especially in this aspect, the refill unit 70 is arranged in the front face 71 of the multifunction device 10, and the operator can insert/extract the ink cartridge 63 from the front face of the refill unit 70 so that the operations to replace the ink cartridge 63 are made simpler. When the door 76 is changed into the opened position, as shown in FIG. 8, the bent portion 97 of the drawer member 77 is turned to push the end face 121 of the ink cartridge 63 so that the ink cartridge 63 is extracted from the case 75. Moreover, the bent portion 97 constitutes the guide member for inserting the new ink cartridge as it is into the case 75. In short, the drawer member 77 acts as the aforementioned guide member so that the operations to replace the ink cartridge 63 are made far simpler.

What is claimed is:

1. A refill unit comprising:

a case having an opening formed in a front face thereof for inserting/extracting an ink cartridge and a holding portion communicated with the opening for housing the ink cartridge;

a door being capable of moving between a closed position to close the opening and an opened position to open the opening;

a locking member being capable of sliding between a protruded position, at which the locking member is protruded from the door, and a retracted position, at which the locking member is retracted toward the door, and adapted to engage with the case at an intermediate position between the protruded position and the retracted position to lock the door in the closed position, the locking member being capable of being displaced toward the retracted position to release the engagement; and an unlocking member turnably supported on the door and being capable of moving, when the door is in the closed position, between a neutral position, at which the unlocking member is inclined from the front face of the case, and a housed position, at which the unlocking member is substantially parallel with the front face of the case, the unlocking member being capable of being displaced from the neutral position to a fallen position to displace the locking member from the intermediate position to the retracted position.

2. The refill unit according to claim 1, wherein the door comprises an elastic member that urges the locking member toward the protruded position.

3. The refill unit according to claim 1, wherein the locking member comprises an abutting portion, against which a predetermined portion of the unlocking member abuts, and the unlocking member comprises, at its predetermined portion, an interlocking cam that presses the abutting portion in association with the displacement of the unlocking member from the housed position to the fallen position and displaces the locking member to the retracted position.

4. The refill unit according to claim 1, wherein the door comprises a housing portion that houses the unlocking member when the unlocking member is displaced to the housed position.

5. The refill unit according to claim 1, wherein the unlocking member is provided with a mark that indicate a direction in which the unlocking member is displaced toward the fallen position.

6. The refill unit according to claim 1, wherein the locking member is provided on one side of the door and the unlocking member is provided on another side of the door.

7. The refill unit according to claim 1, wherein an upper face of the locking member, which comes into sliding contact with the case when the door is moved toward the closed position, is sloped.

* * * * *